US012723516B2

(12) United States Patent
Bonkohara et al.

(10) Patent No.: US 12,723,516 B2
(45) Date of Patent: Sep. 1, 2026

(54) ROTOR DISK, TURBINE BLADE, AND TURBINE BLADE ASSEMBLY EQUIPPED WITH THESE

(71) Applicant: MITSUBISHI HEAVY INDUSTRIES, LTD., Tokyo (JP)

(72) Inventors: Sho Bonkohara, Tokyo (JP); Masamitsu Okuzono, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/600,026

(22) Filed: Mar. 8, 2024

(65) Prior Publication Data

US 2024/0309762 A1 Sep. 19, 2024

(30) Foreign Application Priority Data

Mar. 14, 2023 (JP) ..... 2023-039282

(51) Int. Cl.
*F01D 5/30* (2006.01)
*F04D 29/32* (2006.01)

(52) U.S. Cl.
CPC ..... *F01D 5/3007* (2013.01); *F04D 29/322* (2013.01)

(58) Field of Classification Search
CPC ..... F01D 5/3007; F04D 29/322
See application file for complete search history.

(56) References Cited

U.S. PATENT DOCUMENTS

| | | | | |
|---|---|---|---|---|
| 4,692,976 | A * | 9/1987 | Andrews | F01D 5/3007 29/889.7 |
| 5,593,282 | A | 1/1997 | Krueger | |
| 9,200,516 | B2 * | 12/2015 | Gopalakrishnan | B23P 6/002 |
| 2013/0343895 | A1 | 12/2013 | Garcia-Crespo et al. | |
| 2014/0140852 | A1 * | 5/2014 | Bluck | F01D 5/3007 416/219 R |
| 2016/0084260 | A1 * | 3/2016 | Clarke | F01D 5/3007 416/147 |
| 2016/0312629 | A1 * | 10/2016 | Evans | F01D 5/3007 |

FOREIGN PATENT DOCUMENTS

| | | |
|---|---|---|
| JP | 8-177403 | 7/1996 |
| JP | 2014-5824 | 1/2014 |

* cited by examiner

*Primary Examiner* — Michael K. Reitz
(74) *Attorney, Agent, or Firm* — Wenderoth, Lind & Ponack, L.L.P.

(57) ABSTRACT

A rotor disk includes a blade root groove into which a blade root of a turbine blade is insertable. The blade root groove includes a first bearing surface, a first disk neck outer curved surface which gradually moves toward a first circumferential side as it goes from an edge on an inner radial side of the first bearing surface toward the inner radial side, and a first disk neck inner curved surface which gradually moves toward a second circumferential side as it goes from a first disk neck position corresponding to an edge on the inner radial side of the first disk neck outer curved surface toward the inner radial side. The first disk neck outer curved surface includes a first curvature changing surface of which a curvature gradually increases from the first disk neck position toward an outer radial side.

10 Claims, 10 Drawing Sheets

ROTOR DISK, TURBINE BLADE, AND TURBINE BLADE ASSEMBLY EQUIPPED WITH THESE

CROSS-REFERENCE TO RELATED APPLICATION

Priority is claimed on Japanese Patent Application No. 2023-039282, filed Mar. 14, 2023, the content of which is incorporated herein by reference.

BACKGROUND OF THE INVENTION

Field of the Invention

The present disclosure relates to a rotor disk, a turbine blade attachable to this rotor disk, and a turbine blade assembly equipped with these.

Description of Related Art

A gas turbine includes a compressor which compresses air to generate compressed air, a combustor which burns fuel in the compressed air to generate a combustion gas, and a turbine which is driven by the combustion gas. The turbine includes a turbine rotor which rotates around an axis and a turbine casing which covers the rotor. The turbine rotor includes a rotor shaft which is centered on the axis and a plurality of turbine blade rows which are attached to the rotor shaft. The plurality of turbine blade rows are arranged in an axis direction in which the axis extends. Each of the turbine blade rows includes a plurality of turbine blades which are arranged in a circumferential direction with respect to the axis. The rotor shaft is configured by arranging rotor disks present for each of the plurality of turbine blade rows in the axis direction.

Patent Document 1 below discloses an assembly including a plurality of turbine blades and a rotor disk to which the plurality of turbine blades are attached. Each of the plurality of turbine blades includes a blade body (blade) and a blade root (segment). The rotor disk is provided with a blade root groove (slot) into which the blade root of each of the plurality of turbine blades is fitted.

When the rotor disk is rotating around the axis, a centrifugal force acts on the plurality of turbine blades attached to the rotor. Therefore, in order to prevent the blade root of the turbine blade from coming off from the blade root groove when a centrifugal force is acting on the turbine blade, the blade root groove is formed such that a groove width in a circumferential direction with respect to an axis gradually becomes wider as it goes toward an inner radial side with respect to the axis and gradually becomes narrower as it goes toward the inner radial side with respect to the axis.

PATENT DOCUMENTS

[Patent Document 1] Japanese Unexamined Patent Application, First Publication No. 2014-005824

SUMMARY OF THE INVENTION

In the rotor disk described in Patent Document 1, a circumferential gap of a disk neck portion which is a portion between a portion having the widest groove width in a first blade root groove among a plurality of blade root grooves and a portion having the widest groove width in a second blade root groove adjacent to the first blade root groove in the circumferential direction is narrower than a circumferential gap between a portion having a narrow groove width in the first blade root groove and a portion having a narrow groove width in the second blade root groove. Therefore, when the rotor disk rotates, stress is concentrated on the disk neck portion.

Therefore, an object of the present disclosure is to provide a technology capable of alleviating stress generated in a disk neck portion of a rotor disk.

A rotor disk according to one aspect of the present disclosure for achieving the above-described object is a rotor disk having a disk shape centered on an axis and having a turbine blade on an outer peripheral side.

The rotor disk includes: an outer peripheral surface; and a plurality of blade root grooves which are recessed from the outer peripheral surface toward an inner radial side with respect to the axis and into which a blade root of the turbine blade is insertable. The plurality of blade root grooves are arranged at intervals in a circumferential direction with respect to the axis. Each of the plurality of blade root grooves includes a pair of blade root neck facing surfaces, a pair of bearing surfaces, a pair of disk neck curved surfaces, and a bottom surface. A first blade root neck facing surface which is one surface of the pair of blade root neck facing surfaces spreads in a direction having a component on the inner radial side from a first circumferential position in the circumferential direction of the outer peripheral surface. A second blade root neck facing surface which is the other surface of the pair of blade root neck facing surfaces spreads in a direction having a component on the inner radial side from a second circumferential position separated from the first circumferential position toward a second circumferential side between a first circumferential side and the second circumferential side of the circumferential direction in the outer peripheral surface and faces the first blade root neck facing surface in the circumferential direction. A first bearing surface which is one surface of the pair of bearing surfaces is an inclined plane which gradually moves toward the first circumferential side as it goes from an edge on the inner radial side of the first blade root neck facing surface toward the inner radial side. A second bearing surface which is the other surface of the pair of bearing surfaces is an inclined plane which gradually moves toward the second circumferential side as it goes from an edge on the inner radial side of the second blade root neck facing surface toward the inner radial side and faces the first bearing surface in the circumferential direction. A first disk neck curved surface which is one surface of the pair of disk neck curved surfaces includes a first disk neck outer curved surface which gradually moves toward the first circumferential side as it goes from an edge on the inner radial side of the first bearing surface toward the inner radial side and a first disk neck inner curved surface which gradually moves toward the second circumferential side as it goes from a first disk neck position corresponding to an edge on the inner radial side of the first disk neck outer curved surface toward the inner radial side. A second disk neck curved surface which is the other surface of the pair of disk neck curved surfaces includes a second disk neck outer curved surface which gradually moves toward the second circumferential side as it goes from an edge on the inner radial side of the second bearing surface toward the inner radial side and a second disk neck inner curved surface which gradually moves toward the inner radial side as it goes from a second disk neck position corresponding to an edge on the inner radial side of the second disk neck outer curved surface toward the first circumferential side. The second disk neck outer curved surface faces the first disk neck outer curved surface in the circumferential direction.

The second disk neck inner curved surface faces the first disk neck inner curved surface in the circumferential direction. The second disk neck position faces the first disk neck position in the circumferential direction. The bottom surface is a plane which faces an outer radial side opposite to the inner radial side and connects an edge on the inner radial side of the first disk neck inner curved surface and an edge on the inner radial side of the second disk neck inner curved surface. The first disk neck outer curved surface includes a first curvature changing surface of which a curvature gradually increases from the first disk neck position toward the outer radial side. The second disk neck outer curved surface includes a second curvature changing surface of which a curvature gradually increases from the second disk neck position toward the outer radial side.

In this aspect, the gap between the first disk neck position and the second disk neck position in the circumferential direction is the maximum groove width of the blade root groove in the circumferential direction.

In order to describe the effect of this aspect, a rotor disk of a comparative example will be described below.

As in the rotor disk of this aspect, the rotor disk of the comparative example also includes a blade root groove which is recessed from an outer peripheral surface toward an inner radial side.

As in the blade root groove of this aspect, the blade root groove of the comparative example also includes a first blade root neck facing surface, a second blade root neck facing surface, a first bearing surface, a second bearing surface, a first disk neck outer curved surface, a second disk neck outer curved surface, a first disk neck inner curved surface, a second disk neck inner curved surface, and a bottom surface. In the above-described surfaces of the comparative example, the first disk neck outer curved surface and the second disk neck outer curved surface are different from the corresponding surfaces of the blade root groove of this aspect.

The first disk neck outer curved surface of the comparative example includes a first constant curvature surface instead of the first curvature changing surface of the first disk neck outer curved surface of the above-described aspect. The first constant curvature surface is an arc surface defined by a part of a first circle centered on a point inside the blade root groove. Further, the second disk neck outer curved surface of the comparative example includes a second constant curvature surface instead of the second curvature changing surface of the second disk neck outer curved surface of the above-described embodiment. The second constant curvature surface is an arc surface defined by a part of a second circle centered on a point inside the blade root groove.

Even in the comparative example, the gap in the circumferential direction between the first disk neck position corresponding to the edge on the inner radial side of the first constant curvature surface and the second disk neck position corresponding to the edge on the inner radial side of the second constant curvature surface is the maximum groove width in the circumferential direction of the blade root groove.

Here, it is assumed that the ratio of a change amount in the circumferential direction with respect to a unit change amount toward the radial direction of each surface described above is defined as a change rate.

Further, in this aspect, it is assumed that the change rate of the edge on the outer radial side of the first curvature changing surface and the change rate of the edge on the inner radial side of the surface connected to the outer radial side of the first curvature changing surface match or are similar. Similarly, in the comparative example, it is assumed that the change rate of the edge on the outer radial side of the first constant curvature surface and the change rate of the edge on the inner radial side of the surface connected to the outer radial side of the first constant curvature surface match or are similar.

The first curvature changing surface of this aspect is a curved surface of which a curvature gradually increases as it goes from the first disk neck position toward the outer radial side. Further, the first constant curvature surface of the comparative example is an arc surface defined by a part of a first circle. Therefore, the position in the circumferential direction at the point of the first radial position in the first curvature changing surface is closer to the second circumferential side than the position in the circumferential direction at the point of the first radial position in the first constant curvature surface.

Thus, the first disk neck position of this aspect is closer to the second circumferential side than the first disk neck position of the comparative example.

Further, in this aspect, it is assumed that the change rate of the edge on the outer radial side of the second curvature changing surface and the change rate of the edge on the inner radial side of the surface connected to the outer radial side of the second curvature changing surface match or are similar. Similarly, in the comparative example, it is assumed that the change rate of the edge on the outer radial side of the second constant curvature surface and the change rate of the edge on the inner radial side of the surface connected to the outer radial side of the second constant curvature surface match or are similar.

The second curvature changing surface of this aspect is a curved surface of which a curvature gradually increases from the second disk neck position toward the outer radial side. Further, the second constant curvature surface of the comparative example is an arc surface defined by a part of the second circle. Therefore, the position in the circumferential direction at the point of the first radial position in the second curvature changing surface is closer to the first circumferential side than the position in the circumferential direction at the point of the first radial position in the second constant curvature surface.

Thus, the second disk neck position of this aspect is closer to the first circumferential side than the second disk neck position of the comparative example.

Therefore, in this aspect, the maximum groove width can be narrower than the maximum groove width of the comparative example without changing the width in the circumferential direction of each bearing surface receiving a load from the blade root from the width in the circumferential direction of each bearing surface of the comparative example. In other words, in this aspect, the minimum gap between the blade root grooves adjacent to each other in the circumferential direction can be wider than the minimum gap between the blade root grooves adjacent to each other in the circumferential direction of the comparative example without changing the width in the circumferential direction of each bearing surface receiving a load from the blade root from the width in the circumferential direction of each bearing surface of the comparative example. That is, in this aspect, it is possible to widen the gap in the circumferential direction of the disk neck portion which is a portion between a portion having the widest groove width in the first blade root groove and a portion having the widest groove width in the second blade root groove adjacent to the first blade root groove in the circumferential direction in the rotor disk compared to the comparative example. Thus, in this aspect, the stress generated in the disk neck portion of the rotor disk can be alleviated compared to the comparative example.

Further, in this aspect, the curvature on the surface around the first disk neck position and the curvature on the surface around the second disk neck position are smaller than those of the comparative example. Thus, in this aspect, from this viewpoint, the stress generated in the disk neck portion of the rotor disk can be alleviated compared to the comparative example.

A turbine blade according to one aspect of the present disclosure for achieving the above-described object includes: a blade body which has an airfoil-shaped cross section and extends in a blade height direction perpendicular to the cross section; and a blade root which is provided on a second blade height side of the blade body between a first blade height side and the second blade height side of the blade height direction and is fitted into a blade root groove of a rotor disk having a disk shape centered on an axis.

The blade body includes a leading edge, a trailing edge, a concave curved pressure surface which connects the leading edge and the trailing edge, and a convex curved suction surface which connects the leading edge and the trailing edge. The blade root includes a front-end surface which faces a front side which is a side where the leading edge is present with respect to the trailing edge, a rear-end surface which faces a rear side opposite to the front side, and a side surface which connects an edge of the front-end surface and an edge of the rear-end surface. The side surface of the blade root includes a pair of neck surfaces, a pair of bearing surfaces, a pair of disk neck facing curved surfaces, and a bottom surface. A first neck surface which is one surface of the pair of neck surfaces spreads in a direction having a component on the blade height direction. A second neck surface which is the other surface of the pair of neck surfaces spreads in a direction having a component on the blade height direction, faces the first neck surface in a lateral direction along the front-end surface to be perpendicular to the blade height direction, and is located on a second lateral side between a first lateral side and the second lateral side of the lateral direction with respect to the first neck surface. A first bearing surface which is one surface of the pair of bearing surfaces is an inclined plane which gradually moves toward the first lateral side as it goes from an edge on the second blade height side of the first neck surface toward the second blade height side.

A second bearing surface which is the other surface of the pair of bearing surfaces is an inclined plane which gradually moves toward the second lateral side as it goes from an edge on the second blade height side of the second neck surface toward the second blade height side and faces the first bearing surface in the lateral direction. A first disk neck facing curved surface which is one surface of the pair of disk neck facing curved surfaces includes a first disk neck facing outer curved surface which gradually moves toward the first lateral side as it goes from an edge on the second blade height side of the first bearing surface toward the second blade height side and a first disk neck facing inner curved surface which gradually moves toward the second lateral side as it goes from a first veritop position corresponding to an edge on the second blade height side of the first disk neck facing outer curved surface toward the second blade height side. A second disk neck facing curved surface which is the other surface of the pair of disk neck facing curved surfaces includes a second disk neck facing outer curved surface which gradually moves toward the second lateral side as it goes from an edge on the second blade height side of the second bearing surface toward the second blade height side and a second disk neck facing inner curved surface which gradually moves toward the first lateral side as it goes from a second veritop position corresponding to an edge on the second blade height side of the second disk neck facing outer curved surface toward the second blade height side. The second disk neck facing outer curved surface faces the first disk neck facing outer curved surface in the lateral direction. The second disk neck facing inner curved surface faces the first disk neck facing inner curved surface in the lateral direction. The second veritop position faces the first veritop position in the lateral direction. The bottom surface is a plane which faces the second blade height side and connects an edge on the second blade height side of the first disk neck facing inner curved surface and edge on the second blade height side of the second disk neck facing inner curved surface. The first disk neck facing outer curved surface includes a first curvature changing surface of which a curvature gradually increases from the first veritop position toward the first blade height side. The second disk neck facing outer curved surface includes a second curvature changing surface of which a curvature gradually increases from the second veritop position toward the first blade height side.

The surface shape of the disk neck facing curved surface of the turbine blade of this aspect corresponds to the surface shape of the disk neck curved surface of the blade root groove of the one aspect. Therefore, the blade root of the turbine blade of this aspect is easily fitted into the blade root groove of the one aspect. That is, when the blade root groove of the one aspect is adopted, assembling workability of the turbine blade to the rotor disk can be improved by adopting the blade root of this aspect.

A turbine blade assembly according to one aspect of the present disclosure for achieving the above-described object includes: the rotor disk of the one aspect; and the turbine blade of the one aspect. The blade root of the turbine blade is fitted to any one of the plurality of blade root grooves of the rotor disk. The blade height direction regarding the turbine blade forms the radial direction, the first blade height side forms the outer radial side, and the second blade height side forms the inner radial side. The lateral direction regarding the turbine blade forms the circumferential direction, the first lateral side forms the first circumferential side, and the second lateral side forms the second circumferential side. The first neck surface of the turbine blade faces the first blade root neck facing surface of the blade root groove. The second neck surface of the turbine blade faces the second blade root neck facing surface of the blade root groove. The first bearing surface of the turbine blade faces the first bearing surface of the blade root groove. The second bearing surface of the turbine blade faces the second bearing surface of the blade root groove. The first disk neck facing outer curved surface of the turbine blade faces the first disk neck outer curved surface of the blade root groove. The second disk neck facing outer curved surface of the turbine blade faces the second disk neck outer curved surface of the blade root groove. The first disk neck facing inner curved surface of the turbine blade faces the first disk neck inner curved surface of the blade root groove. The second disk neck facing inner curved surface of the turbine blade faces the first disk neck inner curved surface of the blade root groove. When the first neck surface of the turbine blade is in contact with the first blade root neck facing surface of the blade root groove, the second neck surface of the turbine blade is in contact with the second blade root neck facing surface of the blade root groove.

The turbine blade assembly of this aspect includes the rotor disk of the one aspect. Thus, even in this aspect, the stress generated in the disk neck portion of the rotor disk can be alleviated as in the rotor disk of the above-described aspect.

Further, the turbine blade assembly of this aspect includes the turbine blade of the one aspect. Thus, even in this aspect, as in the turbine blade of the one aspect, assembling workability of the turbine blade to the rotor disk can be improved.

According to the rotor disk and the turbine vane assembly of one aspect of the present disclosure, the stress generated in the disk neck portion of the rotor disk can be alleviated. Further, according to the turbine blade of one aspect of the present disclosure, assembling workability to the rotor disk of the one aspect can be improved.

DETAILED DESCRIPTION OF THE INVENTION

Hereinafter, embodiments and modified examples of a rotor disk, a turbine blade, and a turbine blade assembly equipped with these of the present disclosure will be described in detail with reference to the drawings.

"Embodiment of Turbine Blade Assembly"

A turbine blade assembly of this embodiment is a part of a gas turbine. Therefore, first, a gas turbine including the turbine blade assembly will be described.

Figure 1:
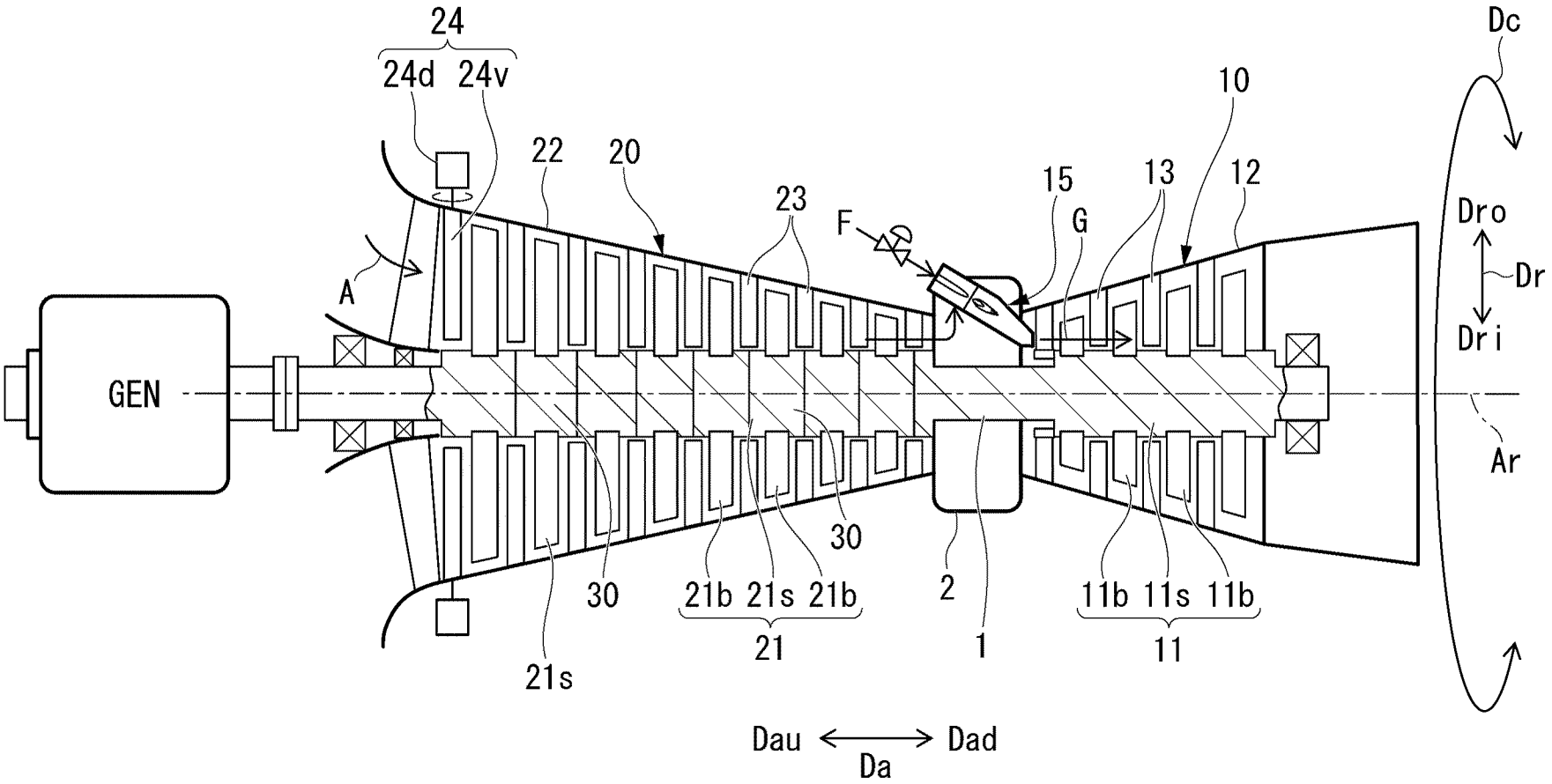
FIG. 1 is a schematic cross-sectional view of a gas turbine according to an embodiment of the present disclosure.

The gas turbine includes, as shown in FIG. 1, a compressor 20 which is able to generate compressed air by compressing air A, a combustor 15 which is able to generate a combustion gas G by burning fuel F in the compressed air, and a turbine 10 which is driven by the combustion gas G having a high temperature and a high pressure.

The compressor 20 includes a compressor rotor 21 which is rotatable around a rotor axis Ar, a compressor casing 22 which covers the compressor rotor 21, a plurality of compressor vane rows 23, and an intake air volume regulator 24. The turbine 10 includes a turbine rotor 11 which is rotatable around the rotor axis Ar, a turbine casing 12 which covers the turbine rotor 11, and a plurality of turbine vane rows 13. Furthermore, hereinafter, the direction in which the rotor axis Ar extends is referred to as the rotor axis direction Da, one side in the rotor axis direction Da is referred to as the upstream axis side Dau, and the other side in the rotor axis direction Da is referred to as the downstream axis side Dad. Further, the circumferential direction centered on the rotor axis Ar is simply referred to as the circumferential direction Dc. Further, the direction perpendicular to the rotor axis Ar is referred to as the radial direction Dr, the side close to the rotor axis Ar in the radial direction Dr is referred to as the inner radial side Dri, and the opposite side is referred to as the outer radial side Dro.

The compressor 20 is disposed on the upstream axis side Dau with respect to the turbine 10. The compressor rotor 21 includes a compressor rotor shaft 21*s* which extends in the rotor axis direction Da with the rotor axis Ar as the center and a plurality of compressor blade rows 21*b* which are attached to the compressor rotor shaft 21*s*. The plurality of compressor blade rows 21*b* are arranged in the rotor axis direction Da. Each compressor blade row 21*b* is composed of a plurality of turbine blades arranged in the circumferential direction Dc. Any one of the plurality of compressor vane rows 23 is disposed on the downstream axis side Dad of each of the plurality of compressor blade rows 21*b*. Each compressor vane row 23 is attached to the inside of the compressor casing 22. Each compressor vane row 23 is composed of a plurality of turbine vanes arranged in the circumferential direction Dc. The intake air volume regulator 24 includes a plurality of inlet guide vanes (IGV) 24*v* and a driver 24*d* which is able to change the direction of each inlet guide vane 24*v*. The plurality of inlet guide vanes 24*v* are arranged on the upstream axis side Dau in relation to the plurality of compressor blade rows 21*b*. The plurality of inlet guide vanes 24*v* are arranged in the circumferential direction.

The turbine rotor 11 includes a turbine rotor shaft 11*s* which extends in the rotor axis direction Da with the axis Ar as a center and a plurality of turbine blade rows 11*b* which are attached to the turbine rotor shaft 11*s*. The plurality of turbine blade rows 11*b* are arranged in the rotor axis direction Da. Each turbine blade row 11*b* is composed of a plurality of turbine blades arranged in the circumferential direction Dc. Each of the plurality of turbine vane rows 13 is disposed on the upstream axis side Dau of each of the plurality of turbine blade rows 11*b*. Each turbine vane row 13 is attached to the inside of the turbine casing 12. Each turbine vane row 13 is composed of a plurality of turbine vanes arranged in the circumferential direction Dc.

The gas turbine further includes an intermediate casing 2. The intermediate casing 2 is disposed between the compressor casing 22 and the turbine casing 12 in the rotor axis direction Da. An end of the intermediate casing 2 on the upstream axis side Dau is connected to the end of the compressor casing 22 on the downstream axis side Dad. An end of the intermediate casing 2 on the downstream axis side Dad is connected to the end of the turbine casing 12 on the upstream axis side Dau. The combustor 15 is attached to this intermediate casing 2.

The compressor rotor 21 and the turbine rotor 11 are located on the same rotor axis Ar, and are connected to each other to form a gas turbine rotor 1. For example, a rotor of a generator GEN is connected to this gas turbine rotor 1.

The compressor rotor shaft 21*s* is configured by stacking a rotor disk 30 which is present for each of the plurality of compressor blade rows 21*b* in the rotor axis direction Da. One compressor blade row 21*b* is attached to one rotor disk 30. The turbine blade assembly of this embodiment includes one rotor disk 30 and a plurality of turbine blades that constitute one compressor blade row 21*b*.

Figure 2:
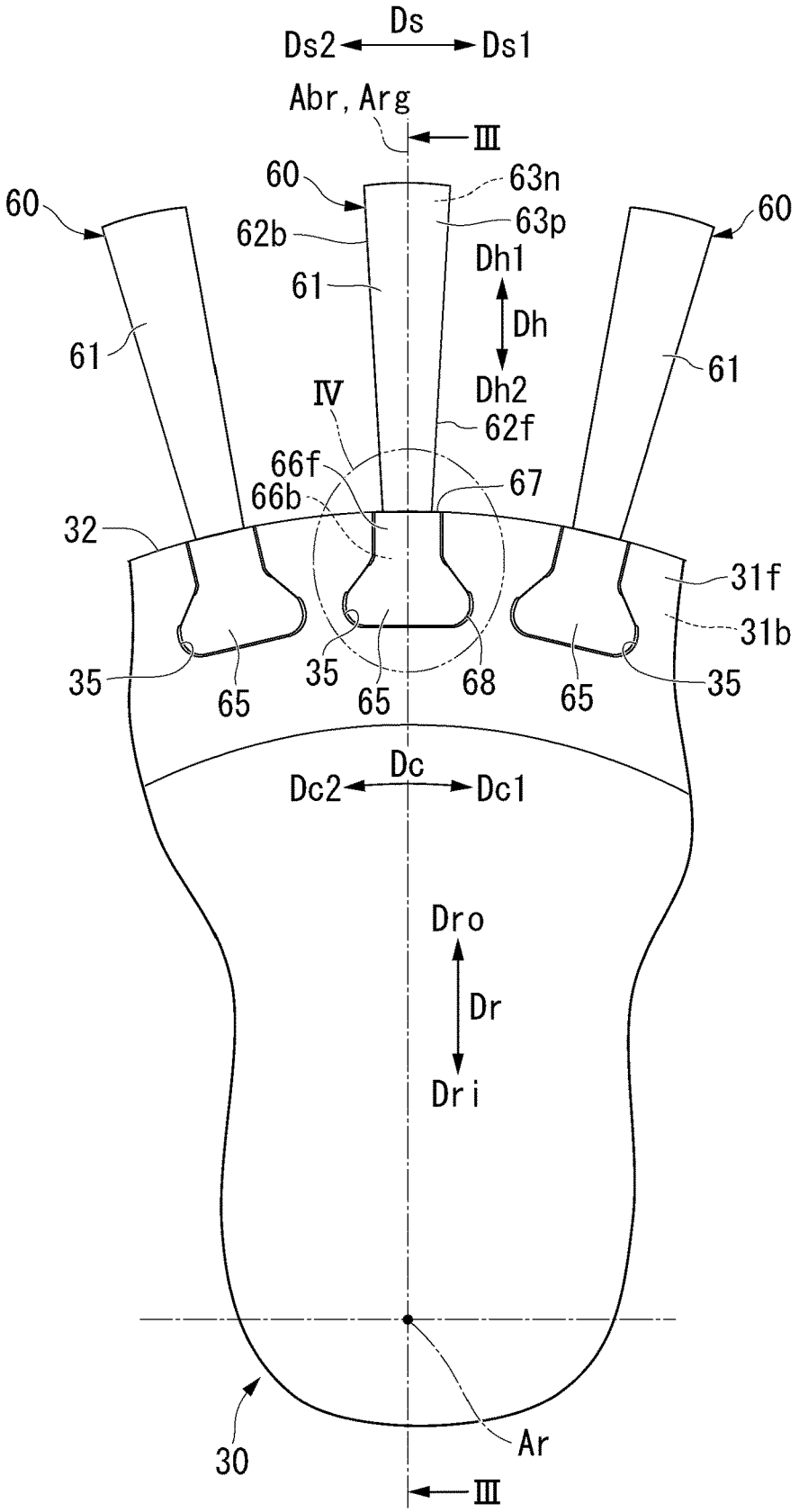
FIG. 2 is a front view of a main part of a turbine blade assembly according to the embodiment of the present disclosure.
Figure 3:
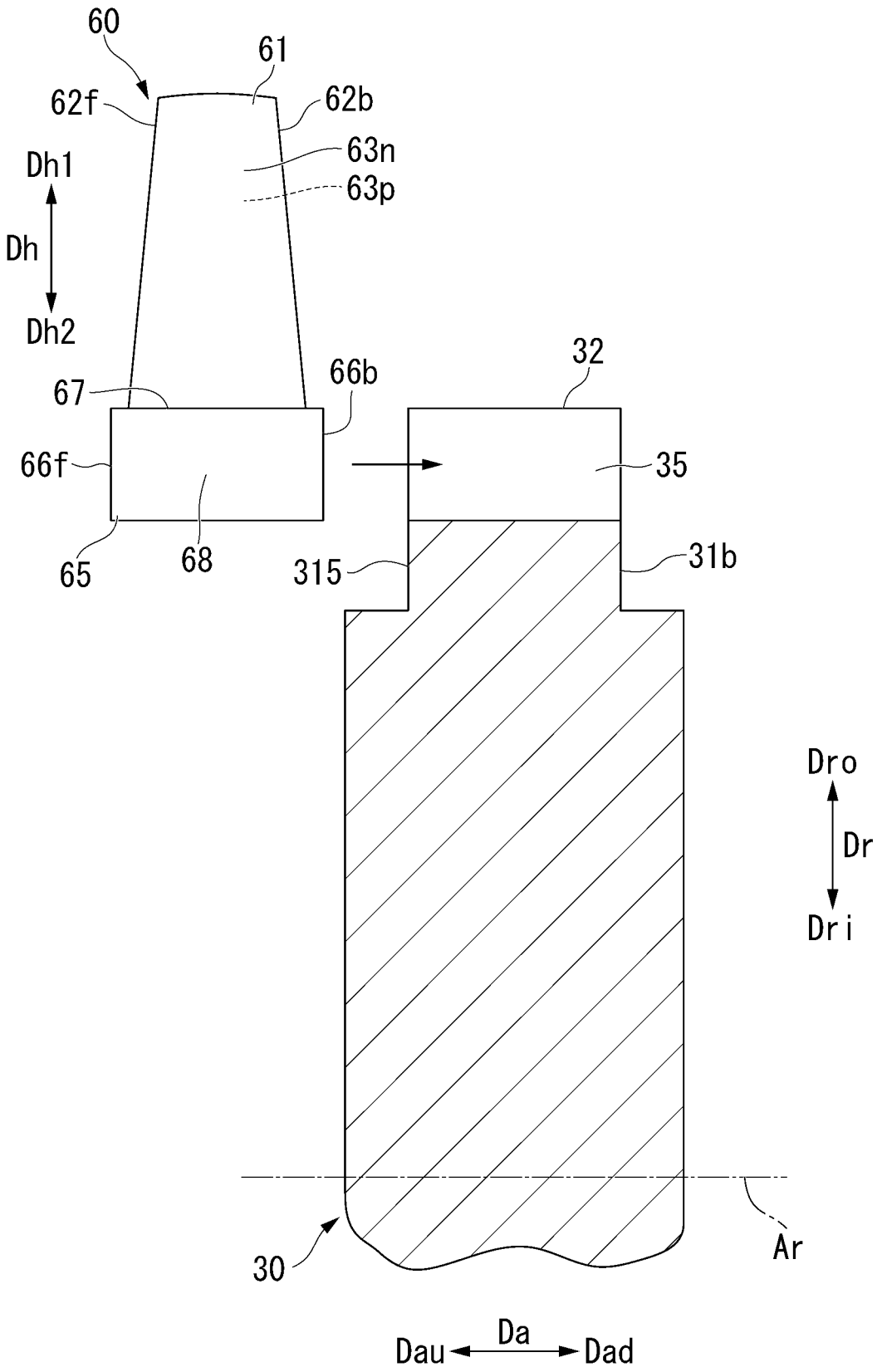
FIG. 3 is a cross-sectional view taken along a line III-III in FIG. 2.

The rotor disk 30 has, as shown in FIGS. 2 and 3, a disk shape centered on the rotor axis Ar. The rotor disk 30 includes front-end surfaces 31*f* and 66*f* which face the upstream axis side Dau, a rear-end surface 31*b* which faces the downstream axis side Dad, an outer peripheral surface 32 which connects the front-end surface 31*f* and the rear-end surface 31*b*, and a plurality of blade root grooves 35 which are recessed from the outer peripheral surface 32 toward the inner radial side Dri. Each blade root groove 35 penetrates the rotor disk 30 in the rotor axis direction Da and extends from the front-end surface 31*f* to the rear-end surface 31*b*.

The turbine blade 60 includes a blade body 61 which has an airfoil-shaped cross section and extends in the blade height direction Dh perpendicular to the cross section and a blade root 65 which can be fitted into the blade root groove 35 of the rotor disk 30.

The blade body 61 includes a leading edge 62*f*, a trailing edge 62*b*, a concave curved pressure surface 63*p* connecting the leading edge 62*f* and the trailing edge 62*b*, and a convex curved suction surface 63*n* connecting the leading edge 62*f* and the trailing edge 62*b*.

Each of the leading edge 62*f*, the trailing edge 62*b*, the pressure surface 63*p*, and the suction surface 63*n* extends in the blade height direction Dh.

The blade root 65 includes a front-end surface 66*f* which faces the front side which is the side where the leading edge 62*f* is present with respect to the trailing edge 62*b*, a rear-end surface 66*b* which faces the rear side which is the side opposite to the front side, a gas path surface 67, and a side surface 68 which connects an edge of the front-end surface 66*f* and an edge of the rear-end surface.

Here, one side in the blade height direction Dh is referred to as a first blade height side Dh1 and the other side in the blade height direction Dh is referred to as a second blade height side Dh2. Further, the direction perpendicular to the blade height direction Dh and along the front-end surface 66*f* is referred to as the lateral direction Ds. Further, one side in the lateral direction Ds is referred to as a first lateral side Ds1 and the other side in the lateral direction Ds is referred to as a second lateral side Ds2. Furthermore, when the blade root 65 of the turbine blade 60 is fitted into the blade root groove 35 of the rotor disk 30, the blade height direction Dh is the radial direction Dr, the first blade height side Dh1 is the outer radial side Dro, and the second blade height side Dh2 is the inner radial side Dri. The lateral direction Ds is the circumferential direction Dc, the first lateral side Ds1 is the first circumferential side Dc1, and the second lateral side Ds2 is the second circumferential side Dc2. The front-end surface 66*f* of the blade root 65 is substantially flush with the front-end surface 31*f* of the rotor disk 30 and the rear-end surface 66*b* of the blade root 65 is substantially flush with the rear-end surface 31*b* of the rotor disk 30.

The blade root 65 is provided at the end of the blade body 61 on the second blade height side Dh2. The gas path surface 67 of the blade root 65 faces the first blade height side Dh1. The gas path surface 67 connects the edge of the front-end surface 66*f* of the blade root 65 on the first blade height side Dh1 and the edge of the rear-end surface 66*b* of the blade root 65 on the first blade height side Dh1. The gas path surface 67 is a surface that defines a part of the air flow path within the compressor casing 22. The rear-end surface 66*b* of the blade root 65 is parallel to the front-end surface 66*f* of the blade root 65. An imaginary line passing through the center between the edge of the first lateral side Ds1 and the edge of the second lateral side Ds2 of the gas path surface 67 and extending in the blade height direction Dh forms a blade root symmetry axis Abr.

Figure 4:
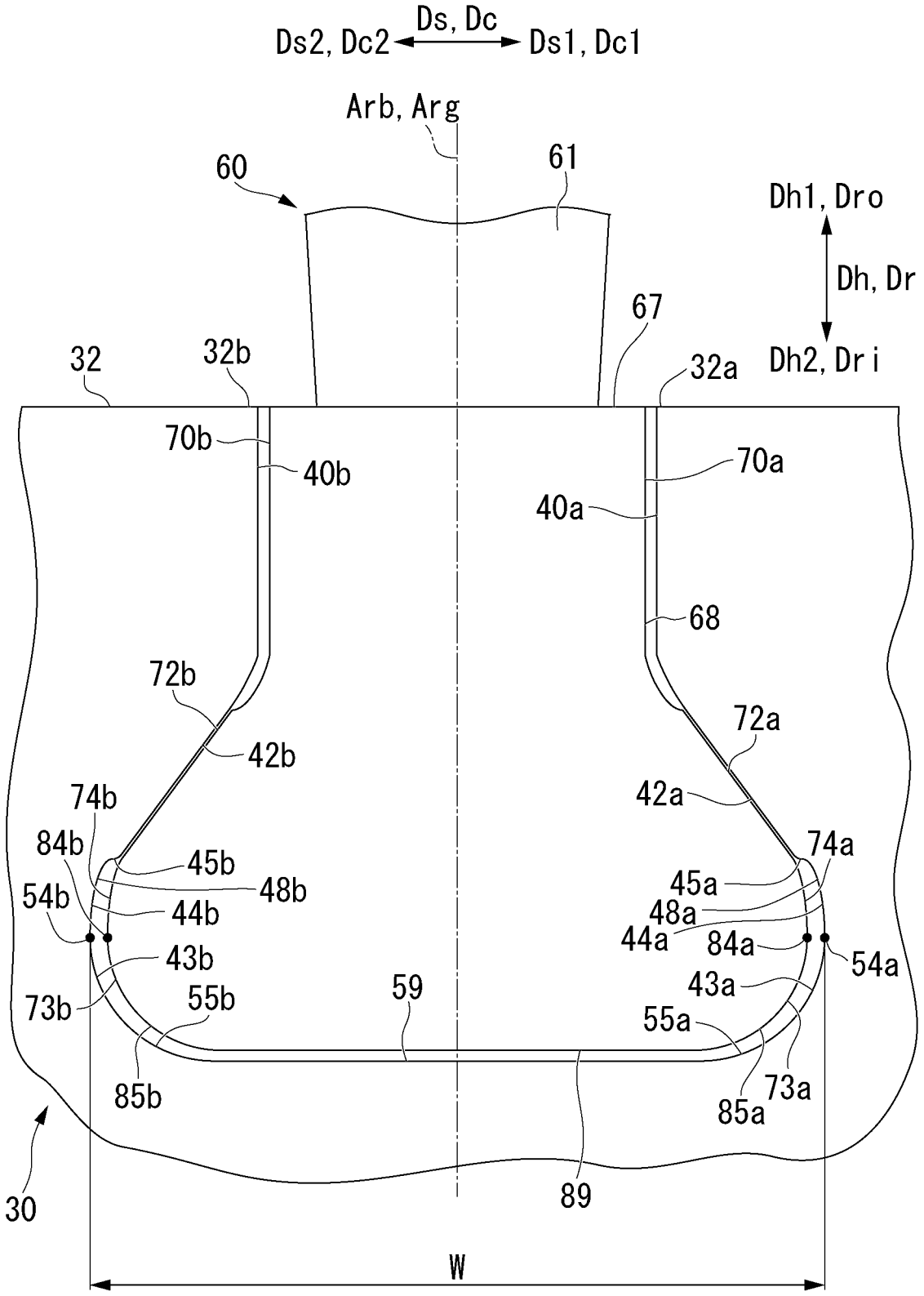
FIG. 4 is an enlarged front view of a part IV in FIG. 2.

The side surface 68 of the blade root 65 includes, as shown in FIG. 4, a pair of neck surfaces 70*a* and 70*b*, a pair of bearing surfaces 72*a* and 72*b*, a pair of disk neck facing curved surfaces 73*a* and 73*b*, and a bottom surface 89.

The first neck surface 70*a* which is one surface of the pair of neck surfaces 70*a* and 70*b* spreads from the edge on the first lateral side Ds1 of the gas path surface 67 in a direction having a component on the second blade height side Dh2 and faces the first lateral side Ds1. The second neck surface 70*b* which is the other surface of the pair of neck surfaces 70*a* and 70*b* spreads from the edge on the second lateral side Ds2 of the gas path surface 67 in a direction having a component on the second blade height side Dh2 and faces the second lateral side Ds2. Thus, the second neck surface 70*b* is located on the second lateral side Ds2 in relation to the first neck surface 70*a* and faces the first neck surface 70*a* in the lateral direction Ds. The second neck surface 70*b* is line symmetrical with the first neck surface 70*a* with respect to the blade root symmetry axis Abr.

The first bearing surface 72*a* which is one surface of the pair of bearing surfaces 72*a* and 72*b* is an inclined plane which gradually moves toward the first lateral side Ds1 as it goes from the edge on the second blade height side Dh2 of the first neck surface 70*a* toward the second blade height side Dh2. The second bearing surface 72*b* which is the other surface of the pair of bearing surfaces 72*a* and 72*b* is an inclined plane which gradually moves toward the second lateral side Ds2 as it goes from the edge on the second blade height side Dh2 of the second neck surface 70*b* toward the second blade height side Dh2. Thus, the second bearing surface 72*b* is located on the second lateral side Ds2 in relation to the first bearing surface 72*a* and faces the first bearing surface 72*a* in the lateral direction Ds. The second bearing surface 72*b* is line symmetrical with the first bearing surface 72*a* with respect to the blade root symmetry axis Abr.

The first disk neck facing curved surface 73*a* which is one surface of the pair of disk neck facing curved surfaces 73*a* and 73*b* includes a first disk neck facing outer curved surface 74*a* which gradually moves toward the first lateral side Ds1 as it goes from the edge on the second blade height side Dh2 of the first bearing surface 72*a* toward the second blade height side Dh2 and a first disk neck facing inner curved surface 85*a* which gradually moves toward the second lateral side Ds2 as it goes from a first veritop position 84*a* corresponding to the edge of the first disk neck facing outer curved surface 74*a* on the second blade height side Dh2 toward the second blade height side Dh2. The second disk neck facing curved surface 73*b* which is the other surface of the pair of disk neck facing curved surfaces 73*a* and 73*b* includes a second disk neck facing outer curved surface 74*b* which gradually moves toward the second lateral side Ds2 as it goes from the edge on the second blade height side Dh2 of the second bearing surface 72*b* toward the second blade height side Dh2 and a second disk neck facing inner curved surface 85*b* which gradually moves toward the first lateral side Ds1 as it goes from a second veritop position 84*b* corresponding to the edge of the second disk neck facing outer curved surface 74*b* on the second blade height side Dh2 toward the second blade height side Dh2. Thus, the second disk neck facing outer curved surface 74*b* is located on the second lateral side Ds2 in relation to the first disk neck facing outer curved surface 74*a* and faces the first disk neck facing outer curved surface 74*a* in the lateral direction Ds. The second disk neck facing outer curved surface 74*b* is line symmetrical with the first disk neck facing outer curved surface 74*a* with respect to the blade root symmetry axis Abr. Further, the second disk neck facing inner curved surface 85*b* is located on the second lateral side Ds2 in relation to the first disk neck facing inner curved surface 85*a* and faces the first disk neck facing inner curved surface 85*a* in the lateral direction Ds. The second disk neck facing inner curved surface 85*b* is line symmetrical with the first disk neck facing inner curved surface 85*a* with respect to the blade root symmetry axis Abr. Further, the second veritop position 84*b* is located on the second lateral side Ds2 in relation to the first veritop position 84*a* and faces the first veritop position 84*a* in the lateral direction Ds.

The bottom surface 89 is a plane which faces the second blade height side Dh2 and connects the edge of the first disk neck facing inner curved surface 85*a* on the second blade height side Dh2 and the edge of the second disk neck facing inner curved surface 85*b* on the second blade height side Dh2.

The blade root groove 35 of the rotor disk 30 includes a pair of blade root neck facing surfaces 40*a* and 40*b*, a pair of bearing surfaces 42*a* and 42*b*, a pair of disk neck curved surfaces 43*a* and 43*b*, and a bottom surface 59.

The first blade root neck facing surface 40*a* which is one surface of the pair of blade root neck facing surfaces 40*a* and 40*b* spreads from a first circumferential position 32*a* of the outer peripheral surface 32 in the circumferential direction Dc in a direction having a component on the inner radial side Dri and faces the second circumferential side Dc2. The second blade root neck facing surface 40*b* which is the other surface of the pair of blade root neck facing surfaces 40*a* and 40*b* spreads from a second circumferential position 32*b* separated from the first circumferential position 32*a* toward the second circumferential side Dc2 in the outer peripheral surface 32 in a direction having a component on the inner radial side Dri and faces the first circumferential side Dc1.

Thus, the second blade root neck facing surface 40*b* is located on the second circumferential side Dc2 in relation to the first blade root neck facing surface 40*a* and faces the first blade root neck facing surface 40*a* in the circumferential direction Dc. Further, the gap between the first blade root neck facing surface 40*a* and the second blade root neck facing surface 40*b* in the circumferential direction Dc is slightly wider than the gap between the first neck surface 70*a* and the second neck surface 70*b* of the blade root 65 in the lateral direction Ds.

An imaginary line passing through the center between the first circumferential position 32*a* and the second circumferential position 32*b* and extending in the radial direction Dr forms a blade root groove symmetry axis Arg. The second blade root neck facing surface 40*b* is line symmetrical with the first blade root neck facing surface 40*a* with respect to the blade root groove symmetry axis Arg. When the blade root 65 of the turbine blade 60 is fitted into the blade root groove 35 of the rotor disk 30, the blade root symmetry axis Abr is located on the blade root groove symmetry axis Arg.

The first bearing surface 42*a* which is one surface of the pair of bearing surfaces 42*a* and 42*b* is an inclined plane which gradually moves toward the first circumferential side Dc1 as it goes from the edge on the inner radial side Dri of the first blade root neck facing surface 40*a* toward the inner radial side Dri. The second bearing surface 42*b* which is the other surface of the pair of bearing surfaces 42*a* and 42*b* is an inclined plane which gradually moves toward the second circumferential side Dc2 as it goes from the edge on the inner radial side Dri of the second blade root neck facing surface 40*b* toward the inner radial side Dri. Thus, the second bearing surface 42*b* is located on the second circumferential side Dc2 in relation to the first bearing surface 42*a* and faces the first bearing surface 42*a* in the circumferential direction Dc. The second bearing surface 42*b* is line symmetrical with the first bearing surface 42*a* with respect to the blade root groove symmetry axis Arg.

The first disk neck curved surface 43*a* which is one surface of the pair of disk neck curved surfaces 43*a* and 43*b* includes a first disk neck outer curved surface 44*a* which gradually moves toward the first circumferential side Dc1 as it goes from the edge on the inner radial side Dri of the first bearing surface 42*a* toward the inner radial side Dri and a first disk neck inner curved surface 55*a* which gradually moves toward the second circumferential side Dc2 as it goes from a first disk neck position 54*a* corresponding to the edge of the first disk neck outer curved surface 44*a* on the inner radial side Dri toward the inner radial side Dri. The second disk neck curved surface 43*b* which is the other surface of the pair of disk neck curved surfaces 43*a* and 43*b* includes a second disk neck outer curved surface 44*b* which gradually moves toward the second circumferential side Dc2 as it goes from the edge on the inner radial side Dri of the second bearing surface 42*b* toward the inner radial side Dri and a second disk neck inner curved surface 55*b* which gradually moves toward the first circumferential side Dc1 as it goes from a second disk neck position 54*b* corresponding to the edge of the second disk neck outer curved surface 44*b* on the inner radial side Dri toward the inner radial side Dri. Thus, the second disk neck outer curved surface 44*b* is located on the second circumferential side Dc2 in relation to the first disk neck outer curved surface 44*a* and faces the first disk neck outer curved surface 44*a* in the circumferential direction Dc. The second disk neck outer curved surface 44*b* is line symmetrical with the first disk neck outer curved surface 44*a* with respect to the blade root groove symmetry axis Arg. Further, the second disk neck inner curved surface 55*b* is located on the second circumferential side Dc2 in relation to the first disk neck inner curved surface 55*a* and faces the first disk neck inner curved surface 55*a* in the circumferential direction Dc. The second disk neck inner curved surface 55*b* is line symmetrical with the first disk neck inner curved surface 55*a* with respect to the blade root groove symmetry axis Arg. Further, the second disk neck position 54*b* is located on the second circumferential side Dc2 in relation to the first disk neck position 54*a* and faces the first disk neck position 54*a* in the circumferential direction Dc.

The gap between the first disk neck position 54*a* and the second disk neck position 54*b* in the circumferential direction Dc is the maximum groove width W of the blade root groove 35 in the circumferential direction Dc.

The bottom surface 59 faces the outer radial side Dro. The bottom surface 59 is a plane which connects the edge of the first disk neck inner curved surface 55*a* on the inner radial side Dri and the edge of the second disk neck inner curved surface 55*b* on the inner radial side Dri.

When the blade root 65 of the turbine blade 60 is fitted into the blade root groove 35 of the rotor disk 30, the first neck surface 70*a* of the turbine blade 60 faces the first blade root neck facing surface 40*a* of the blade root groove 35 and the second neck surface 70*b* of the turbine blade 60 faces the second blade root neck facing surface 40*b* of the blade root groove 35. At this time, the first bearing surface 72*a* of the turbine blade 60 faces the first bearing surface 42*a* of the blade root groove 35 and the second bearing surface 72*b* of the turbine blade 60 faces the second bearing surface 42*b* of the blade root groove 35. At this time, the first disk neck facing outer curved surface 74*a* of the turbine blade 60 faces the first disk neck outer curved surface 44*a* of the blade root groove 35 and the second disk neck facing outer curved surface 74*b* of the turbine blade 60 faces the second disk neck outer curved surface 44*b* of the blade root groove 35. At this time, the first disk neck facing inner curved surface 85*a* of the turbine blade 60 faces the first disk neck inner curved surface 55*a* of the blade root groove 35 and the second disk neck facing inner curved surface 85*b* of the turbine blade 60 faces the second disk neck inner curved surface 55*b* of the blade root groove 35.

When the rotor disk 30 is rotating around the rotor axis Ar, a centrifugal force acts on the turbine blade 60. Therefore, when the rotor disk 30 starts to rotate, the turbine blade 60 moves toward the outer radial side Dro, the first bearing surface 72*a* of the turbine blade 60 is in contact with the first bearing surface 42*a* of the blade root groove 35, and the second bearing surface 72*b* of the turbine blade 60 is in contact with the second bearing surface 42*b* of the blade root groove 35. As a result, when the rotor disk 30 rotates, a load is applied from the turbine blade 60 to the first bearing surface 42*a* and the second bearing surface 42*b* of the blade root groove 35.

Figure 5:
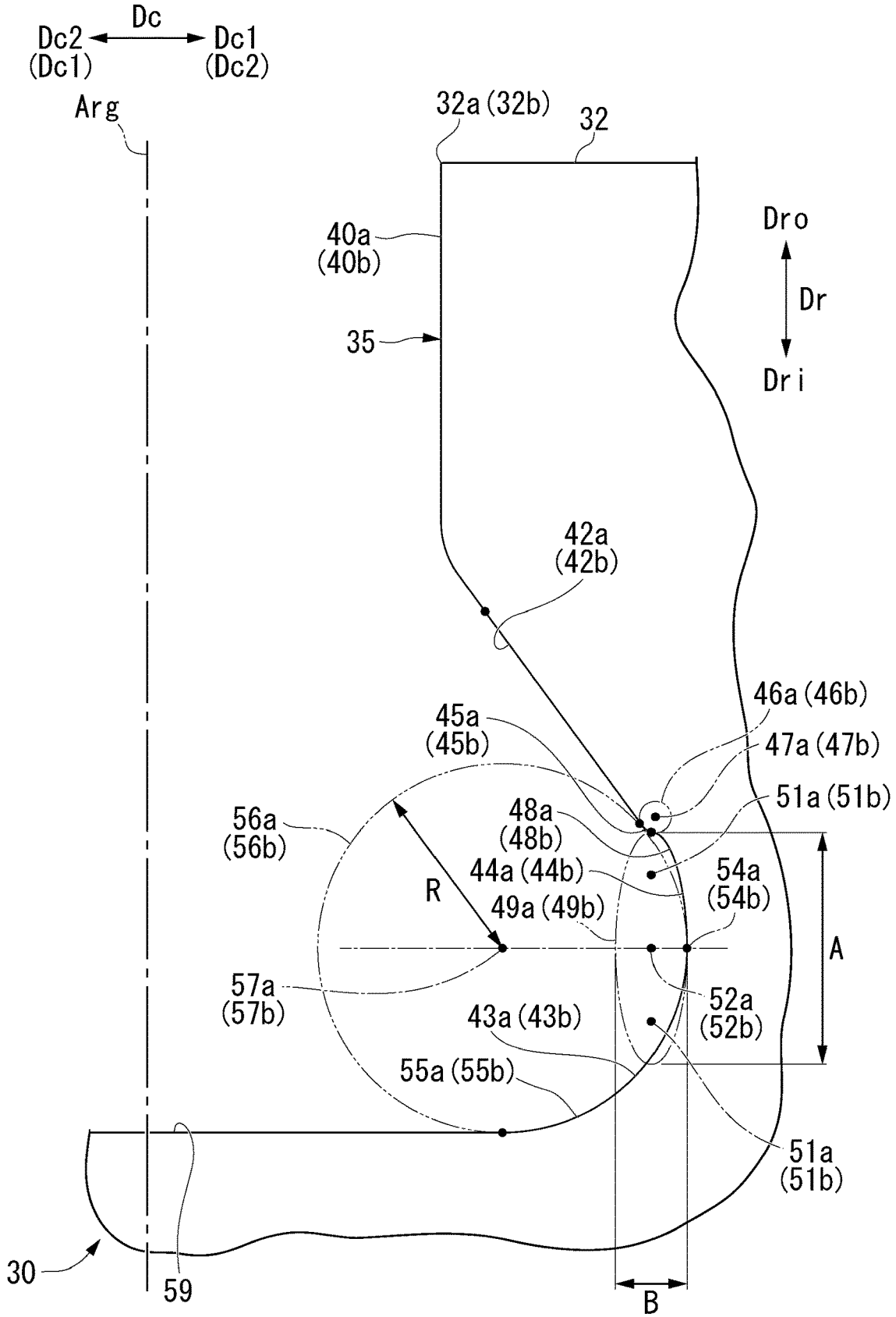
FIG. 5 is a front view of a main part of a rotor disk according to the embodiment of the present disclosure.

As shown in FIG. 5, the first disk neck outer curved surface 44*a* of the blade root groove 35 includes a first flank 45*a* and a first curvature changing surface 48*a*.

The first flank 45*a* is a curved surface which gradually moves toward the first circumferential side Dc1 as it goes from the edge on the inner radial side Dri of the first bearing surface 42*a* toward the inner radial side Dri. A change amount toward the first circumferential side Dc1 with respect to a unit change amount toward the inner radial side Dri in the first flank 45*a* is larger than that of the first bearing surface 42*a*. The first flank 45*a* is an arc surface defined by a part of the first groove outer circle 46*a* centered on a point 47*a* which is outside the blade root groove 35 and closer to the first circumferential side Dc1 than the first bearing surface 42*a*. Thus, the first flank 45*a* does not contact the imaginary plane of the first bearing surface 42*a* extending from the edge on the inner radial side Dri of the first bearing surface 42*a*.

The first curvature changing surface 48*a* is a curved surface of which a curvature gradually increases as it goes from the first disk neck position 54*a* toward the outer radial side Dro. The edge of the first curvature changing surface 48*a* on the outer radial side Dro is connected to the edge of the first flank 45*a* on the inner radial side Dri. The first curvature changing surface 48*a* is an elliptical arc surface defined by a part of the first ellipse 49*a* determined by two focal points 51*a* arranged in the radial direction Dr inside the blade root groove 35.

The first disk neck inner curved surface 55*a* of the blade root groove 35 is an arc surface defined by a part of the first circle 56*a* centered on a point 57*a* inside the blade root groove 35.

As described above, the second disk neck outer curved surface 44*b* of the blade root groove 35 is line symmetrical with the first disk neck outer curved surface 44*a* with respect to the blade root groove symmetry axis Arg. Therefore, the second disk neck outer curved surface 44*b* includes a second flank 45*b* which is line symmetrical with the first flank 45*a* with respect to the blade root groove symmetry axis Arg and a second curvature changing surface 48*b* which is line symmetrical with the first curvature changing surface 48*a* with respect to the blade root groove symmetry axis Arg.

The second flank 45*b* is a curved surface which gradually moves toward the second circumferential side Dc2 as it goes from the edge on the inner radial side Dri of the second bearing surface 42*b* toward the inner radial side Dri. A change amount toward the inner radial side Dri with respect to a unit change amount toward the second circumferential side Dc2 in the second flank 45*b* is larger than that of the second bearing surface 42*b*. The second flank 45*b* is an arc surface defined by a part of the second groove outer circle 46*b* centered on a point 47*b* which is outside the blade root groove 35 and closer to the second circumferential side Dc2 than the second bearing surface 42*b*. Thus, the second flank 45*b* does not contact the imaginary plane of the second bearing surface 42*b* extending from the edge on the inner radial side Dri of the second bearing surface 42*b*.

The second curvature changing surface 48*b* is a curved surface of which a curvature gradually increases as it goes from the second disk neck position 54*b* toward the outer radial side Dro. The edge of the second curvature changing surface 48*b* on the outer radial side Dro is connected to the edge of the second flank 45*b* on the inner radial side Dri. The second curvature changing surface 48*b* is an elliptical arc surface defined by a part of the second ellipse 49*b* determined by two focal points arranged in the radial direction Dr inside the blade root groove 35.

The second disk neck inner curved surface 55*b* of the blade root groove 35 is line symmetrical with the first disk neck inner curved surface 55*a* with respect to the blade root groove symmetry axis Arg. Therefore, the second disk neck inner curved surface 55*b* is an arc surface defined by a part of a second circle 56*b* centered on a point 57*b* inside the blade root groove 35.

The major axis A of the first ellipse 49*a* is larger than the radius R of the first circle 56*a* and the minor axis B of the first ellipse 49*a* is smaller than the radius R of the first circle 56*a*. Further, the major axis A of the second ellipse 49*b* is larger than the radius R of the second circle 56*b* and the minor axis B of the second ellipse 49*b* is smaller than the radius R of the second circle 56*b*. Furthermore, the major axis A of the second ellipse 49*b* is the same as the major axis A of the first ellipse 49*a*. The minor axis B of the second ellipse 49*b* is the same as the minor axis B of the first ellipse 49*a*. The radius R of the second circle 56*b* is the same as the radius R of the first circle 56*a*. Further, an ellipse center 52*a* of the first ellipse 49*a*, the center point 57*a* of the first circle 56*a*, an ellipse center 52*b* of the second ellipse 49*b*, the center point 57*b* of the second circle 56*b*, the first disk neck position 54*a*, and the second disk neck position 54*b* are located on the same straight line.

Figure 6:
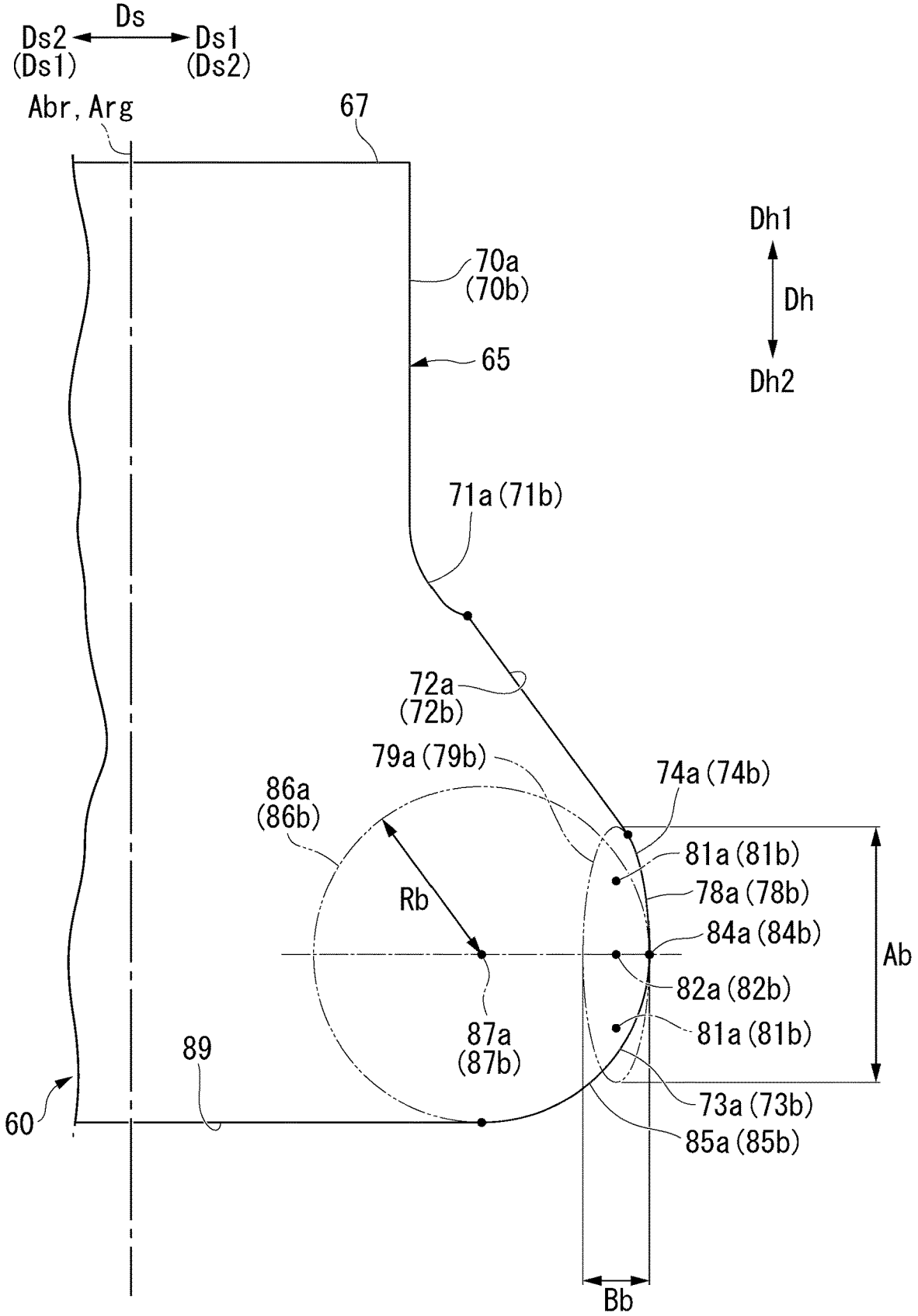
FIG. 6 is a front view of a main part of a blade root according to the embodiment of the present disclosure.

As shown in FIG. 6, the first neck surface 70*a* of the blade root 65 includes a first flank 71*a*.

The first flank 71*a* of the blade root 65 is a curved surface which gradually moves toward the second lateral side Ds2 as it goes from the edge on the first blade height side Dh1 of the first bearing surface 72*a* toward the first blade height side Dh1. A change amount toward the second lateral side Ds2 with respect to a unit change amount toward the first blade height side Dh1 in the first flank 71*a* is larger than a change amount toward the second lateral side Ds2 with respect to a unit change amount toward the first blade height side Dh1 in the first bearing surface 72*a*. Thus, the first flank 71*a* does not contact the imaginary plane of the first bearing surface 72*a* extending from the edge on the first blade height side Dh1 of the first bearing surface 72*a*.

The first disk neck facing outer curved surface 74*a* of the blade root 65 includes a first curvature changing surface 78*a* of which a curvature gradually increases from the first veritop position 84*a* toward the first blade height side Dh1. The first curvature changing surface 78*a* is an elliptical arc surface defined by a part of a first ellipse 79*a* determined by two focal points 81*a* arranged in the blade height direction Dh inside the blade root 65.

The first disk neck facing inner curved surface 85*a* of the blade root 65 is an arc surface defined by a part of the first circle 86*a* centered on a point 87*a* inside the blade root 65.

As described above, the second neck surface 70*b* of the blade root 65 is line symmetrical with the first neck surface 70*a* of the blade root 65 with respect to the blade root symmetry axis Abr. Thus, the second neck surface 70*b* includes a second flank 71*b* which is line symmetrical with the first flank 71*a* in the first neck surface 70*a* with respect to the blade root symmetry axis Abr. A change amount toward the first lateral side Ds1 with respect to a unit change amount toward the first blade height side Dh1 in the second flank 71*b* is larger than a change amount toward the first lateral side Ds1 with respect to a unit change amount toward the first blade height side Dh1 in the second bearing surface 72*b*. Thus, the second flank 71*b* does not contact the imaginary plane of the second bearing surface 72*b* extending from the edge on the first blade height side Dh1 of the second bearing surface 72*b*.

As described above, the second disk neck facing outer curved surface 74*b* of the blade root 65 is line symmetrical with the first disk neck outer curved surface 44*a* with respect to the blade root groove symmetry axis Arg. Therefore, the second disk neck facing outer curved surface 74*b* includes a second curvature changing surface 78*b* of which a curvature gradually increases from the second veritop position 84*b* toward the first blade height side Dh1. The second curvature changing surface 78*b* is an elliptical arc surface defined by a part of the second ellipse 79*b* determined by two focal points 81*b* arranged in the blade height direction Dh inside the blade root 65.

As described above, the second disk neck facing inner curved surface 85*b* of the blade root 65 is line symmetrical with the first disk neck facing inner curved surface 85*a* with respect to the blade root groove symmetry axis Arg. Therefore, the second disk neck facing inner curved surface 85*b* is an arc surface defined by a part of the second circle 86*b* centered on a point 87*b* inside the blade root 65.

The major axis Ab of the first ellipse 79*a* is larger than the radius Rb of the first circle 86*a* and the minor axis Bb of the first ellipse 79*a* is smaller than the radius Rb of the first circle 86*a*. Further, the major axis Ab of the second ellipse 79*b* is larger than the radius Rb of the second circle 86*b* and the minor axis Bb of the second ellipse 79*b* is smaller than the radius Rb of the second circle 86*b*. Furthermore, the major axis Ab of the second ellipse 79*b* is the same as the major axis Ab of the first ellipse 79*a*.

The minor axis Bb of the second ellipse 79*b* is the same as the minor axis Bb of the first ellipse 79*a*. The radius Rb of the second circle 86*b* is the same as the radius Rb of the first circle 86*a*. Further, an ellipse center 82*a* of the first ellipse 79*a*, the center point 87*a* of the first circle 86*a*, an ellipse center 82*b* of the second ellipse 79*b*, the center point 87*b* of the second circle 86*b*, the first veritop position 84*a*, and the second veritop position 84*b* are located on the same straight line.

Figure 7:
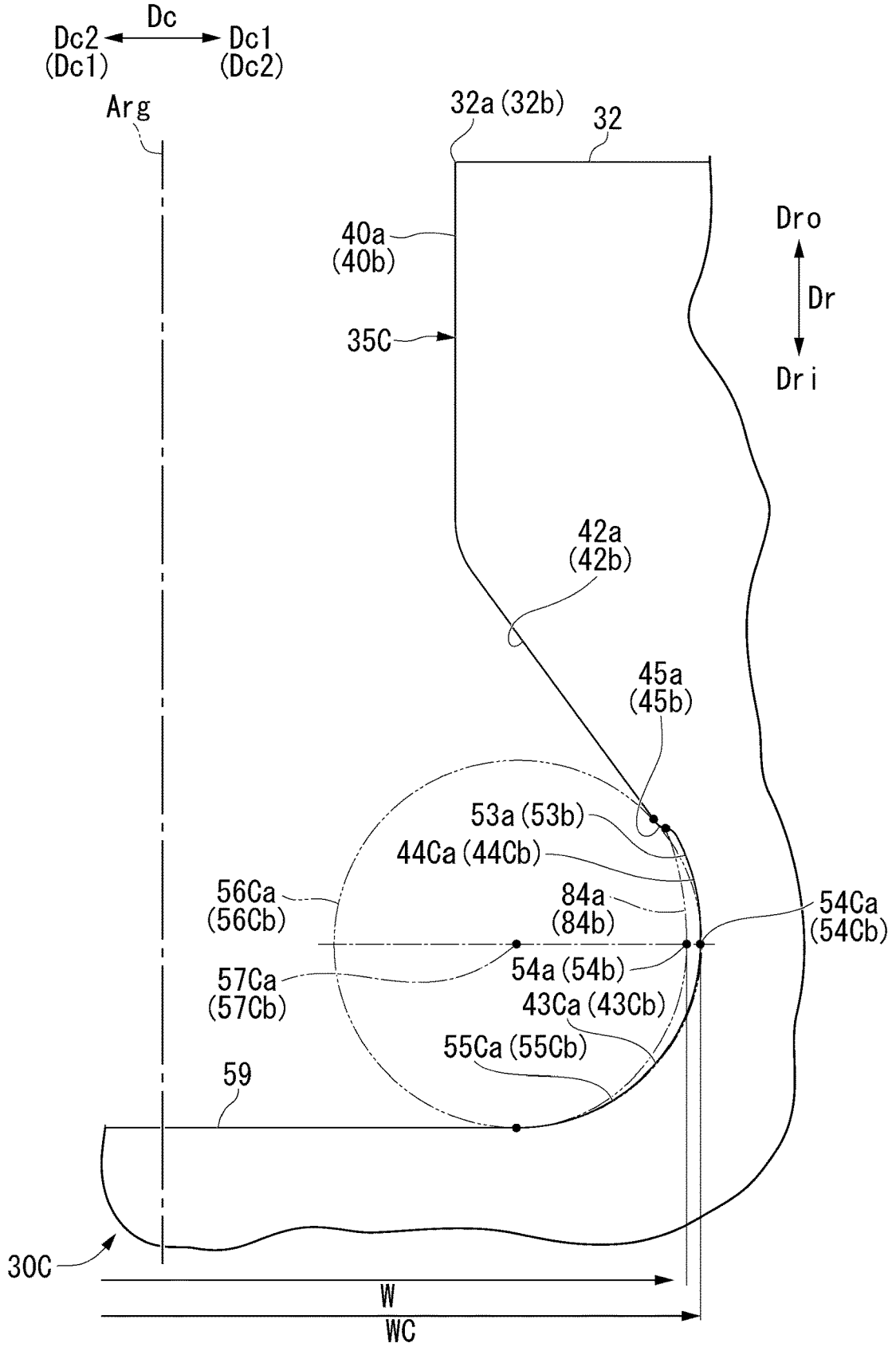
FIG. 7 is a front view of a main part of a rotor disk according to a comparative example.

Next, in order to describe the effect of the rotor disk 30 of this embodiment, a rotor disk 30C as a comparative example will be described with reference to FIG. 7.

The rotor disk 30C of the comparative example includes the outer peripheral surface 32 and a blade root groove 35C which is recessed from the outer peripheral surface 32 toward the inner radial side Dri as in the rotor disk 30 of this embodiment.

As in the blade root groove 35 of this embodiment, the blade root groove 35C of the comparative example also includes the pair of blade root neck facing surfaces 40*a* and 40*b*, the pair of bearing surfaces 42*a* and 42*b*, a pair of disk neck curved surfaces 43Ca and 43Cb, and the bottom surface 59. Furthermore, even in the blade root groove 35C of the comparative example, the pair of blade root neck facing surfaces 40*a* and 40*b* are line symmetrical with each other with respect to the blade root groove symmetry axis Arg, the pair of bearing surfaces 42*a* and 42*b* are line symmetrical with each other with respect to the blade root groove symmetry axis Arg, and the pair of disk neck curved surfaces 43Ca and 43Cb are line symmetrical with each other with respect to the blade root groove symmetry axis Arg as in the blade root groove 35 of this embodiment.

The first blade root neck facing surface 40*a* which is one surface of the pair of blade root neck facing surfaces 40*a* and 40*b* spreads from the first circumferential position 32*a* of the outer peripheral surface 32 in the circumferential direction Dc in a direction having a component on the inner radial side Dri. The second blade root neck facing surface 40*b* which is the other surface of the pair of blade root neck facing surfaces 40*a* and 40*b* spreads from the second circumferential position 32*b* separated from the first circumferential position 32*a* toward the second circumferential side Dc2 in the outer peripheral surface 32 in a direction having a component on the inner radial side Dri.

The first bearing surface 42*a* which is one surface of the pair of bearing surfaces 42*a* and 42*b* is an inclined plane which gradually moves toward the first circumferential side Dc1 as it goes from the edge on the inner radial side Dri of the first blade root neck facing surface 40*a* toward the inner radial side Dri. The second bearing surface 42*b* which is the other surface of the pair of bearing surfaces 42*a* and 42*b* is an inclined plane which gradually moves toward the second circumferential side Dc2 as it goes from the edge on the inner radial side Dri of the second blade root neck facing surface 40*b* toward the inner radial side Dri.

The first disk neck curved surface 43Ca which is one surface of the pair of disk neck curved surfaces 43Ca and 43Cb includes a first disk neck outer curved surface 44Ca which gradually moves toward the first circumferential side Dc1 as it goes from the edge on the inner radial side Dri of the first bearing surface 42*a* toward the inner radial side Dri and a first disk neck inner curved surface 55Ca which gradually moves toward the second circumferential side Dc2 as it goes from a first disk neck position 54Ca corresponding to the edge of the first disk neck outer curved surface 44Ca on the inner radial side Dri toward the inner radial side Dri. The second disk neck curved surface 43Cb which is the other surface of the pair of disk neck curved surfaces 43Ca and 43Cb includes a second disk neck outer curved surface 44Cb which gradually moves toward the second circumferential side Dc2 as it goes from the edge on the inner radial side Dri of the second bearing surface 42*b* toward the inner radial side Dri and a second disk neck inner curved surface 55Cb which gradually moves toward the first circumferential side Dc1 as it goes from a second disk neck position 54Cb corresponding to the edge of the second disk neck outer curved surface 44Cb on the inner radial side Dri toward the inner radial side Dri.

The gap between the first disk neck position 54Ca and the second disk neck position 54Cb in the circumferential direction Dc is the maximum groove width WC of the blade root groove 35C in the circumferential direction Dc.

The bottom surface 59 faces the outer radial side Dro and is a plane which connects the edge of the first disk neck inner curved surface 55Ca on the inner radial side Dri and the edge of the second disk neck inner curved surface 55Cb on the inner radial side Dri.

The first disk neck outer curved surface 44Ca includes the first flank 45*a* and a first constant curvature surface 53*a*. The first disk neck outer curved surface 44Ca includes the first constant curvature surface 53*a* instead of the first curvature changing surface 48*a* of the first disk neck outer curved surface 44Ca of the above-described embodiment. The first constant curvature surface 53*a* is an arc surface defined by a part of a first circle 56Ca centered on a point 57Ca inside the blade root groove 35C.

The first disk neck inner curved surface 55Ca is an arc surface defined by a part of the first circle 56Ca centered on the point 57Ca inside the blade root groove 35C as in the first disk neck inner curved surface 55*a* of the above-described embodiment. That is, the first disk neck inner curved surface 55Ca and the first constant curvature surface 53*a* of the first disk neck outer curved surface 44Ca are arc surfaces defined by a part of the same first circle 56Ca.

The second disk neck outer curved surface 44Cb includes the second flank 45*b* and a second constant curvature surface 53*b*. The second disk neck outer curved surface 44Cb includes the second constant curvature surface 53*b* instead of the second curvature changing surface 48*b* of the first disk neck outer curved surface 44*a* of the above-described embodiment. The second constant curvature surface 53*b* is an arc surface defined by a part of a second circle 56Cb centered on a point 57Cb inside the blade root groove 35C.

The second disk neck inner curved surface 55Cb is an arc surface defined by a part of the second circle 56Cb centered on the point 57Cb inside the blade root groove 35C as in the second disk neck inner curved surface 55*b* of the above-described embodiment. That is, the second disk neck inner curved surface 55Cb and the second constant curvature surface 53*b* of the second disk neck outer curved surface 44Cb are arc surfaces defined by a part of the same second circle 56Cb.

Here, it is assumed that the ratio of a change amount in the circumferential direction Dc with respect to a unit change amount in the radial direction Dr on each surface described above is defined as a change rate.

Further, in this embodiment, it is assumed that the change rate of the edge on the outer radial side Dro of the first curvature changing surface 48*a* and the change rate of the edge on the inner radial side Dri of the surface (first flank 45*a*) connected to the outer radial side Dro of the first curvature changing surface 48*a* match or are similar. Similarly, in the comparative example, it is assumed that the change rate of the edge on the outer radial side Dro of the first constant curvature surface 53*a* and the change rate of the edge on the inner radial side Dri of the surface (first flank 45*a*) connected to the outer radial side Dro of the first constant curvature surface 53*a* match or are similar.

The first curvature changing surface 48*a* of this embodiment is a curved surface of which a curvature gradually increases from the first disk neck position 54*a* toward the outer radial side Dro. Further, the first constant curvature surface 53*a* of the comparative example is an arc surface defined by a part of the first circle 56Ca. Therefore, the position in the circumferential direction Dc at the point of the first radial position in the first curvature changing surface 48*a* is closer to the second circumferential side Dc2 than the position in the circumferential direction Dc at the point of the first radial position of the first constant curvature surface 53*a*.

Thus, the first disk neck position 54*a* of this embodiment is closer to the second circumferential side Dc2 than the first disk neck position 54Ca of the comparative example.

Further, in this embodiment, it is assumed that the change rate of the edge on the outer radial side Dro of the second curvature changing surface 48*b* and the change rate of the edge on the inner radial side Dri of the surface (second flank 45*b*) connected to the outer radial side Dro of the second curvature changing surface 48*b* match or are similar. Similarly, in the comparative example, it is assumed that the change rate of the edge on the outer radial side Dro of the second constant curvature surface 53*b* and the change rate of the edge on the inner radial side Dri of the surface (second flank 45*b*) connected to the outer radial side Dro of the second constant curvature surface 53*b* match or are similar.

The second curvature changing surface 48*b* of this embodiment is a curved surface of which a curvature gradually increases from the second disk neck position 54*b* toward the outer radial side Dro. Further, the second constant curvature surface 53*b* of the comparative example is an arc surface defined by a part of the second circle 56Cb. Therefore, the position in the circumferential direction Dc at the point of the first radial position of the second curvature changing surface 48*b* is closer to the first circumferential side Dc1 than the position in the circumferential direction Dc at the point of the first radial position of the second constant curvature surface 53*b*.

Thus, the second disk neck position 54*b* of this embodiment is closer to the first circumferential side Dc1 than the second disk neck position 54Cb of the comparative example.

Figure 8:
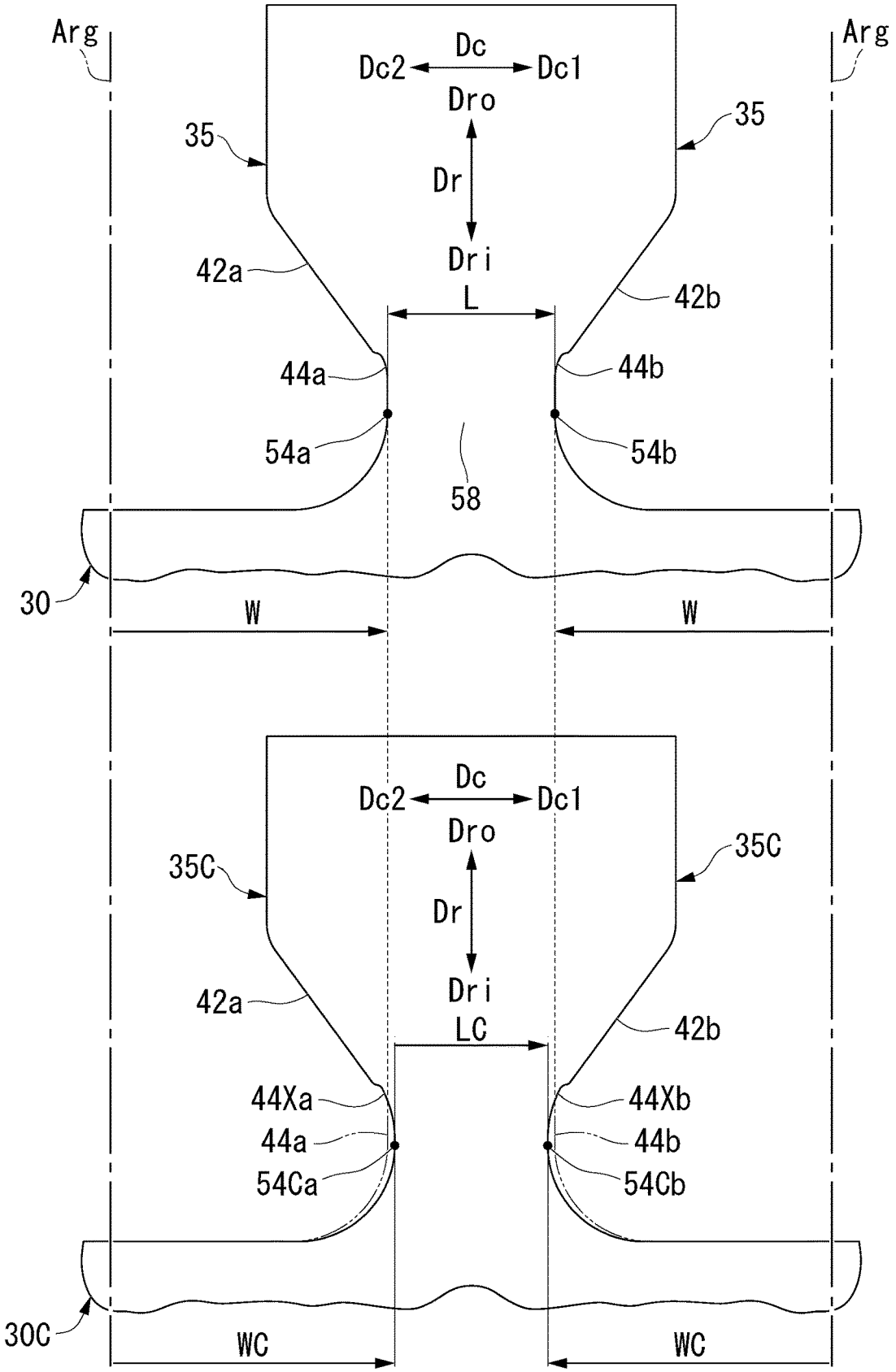
FIG. 8 is an explanatory diagram showing a difference between the rotor disk of the embodiment and the rotor disk of the comparative example.

Therefore, as shown in FIG. 8, in this embodiment, the maximum groove width W of this embodiment can be narrower than the maximum groove width WC of the comparative example without changing the width in the circumferential direction Dc of each of the bearing surfaces 42*a* and 42*b* receiving a load applied from the blade root 65 from the width in the circumferential direction Dc of each of the bearing surfaces 42*a* and 42*b* of the comparative example. In other words, in this embodiment, the minimum gap L of this embodiment between the blade root grooves 35 adjacent to each other in the circumferential direction Dc can be wider than the minimum gap LC between the blade root grooves 35C adjacent to each other in the circumferential direction Dc in the comparative example without changing the width in the circumferential direction Dc of each of the bearing surfaces 42*a* and 42*b* receiving a load applied from the blade root 65 from the width in the circumferential direction Dc of each of the bearing surfaces 42*a* and 42*b* of the comparative example. That is, in this embodiment, it is possible to widen the gap in the circumferential direction Dc of the disk neck portion 58 which is a portion between a portion having the widest groove width in the first blade root groove 35 and a portion having the widest groove width in the second blade root groove 35 adjacent to the first blade root groove 35 in the circumferential direction Dc in the rotor disk 30 compared to the comparative example. Thus, in this embodiment, the stress generated in the disk neck portion 58 of the rotor disk 30 can be alleviated compared to the comparative example.

Further, in this embodiment, the curvature of the surface around the first disk neck position 54*a* becomes smaller than that of the comparative example. Thus, in this embodiment, from this viewpoint, the stress generated in the disk neck portion 58 of the rotor disk 30 can be alleviated compared to the comparative example.

When the rotor disk 30 is rotating, each of the bearing surfaces 42*a* and 42*b* of the blade root groove 35 receives a load from the turbine blade 60. In this embodiment, since the flanks 45*a* and 45*b* are connected to the edges of the bearing surfaces 42*a* and 42*b* on the inner radial side Dri, this load can be suppressed from going around toward the disk neck portion 58. Thus, in this embodiment, from this viewpoint, the stress generated in the disk neck portion 58 of the rotor disk 30 can be alleviated.

"First Modified Example of Turbine Blade Assembly"

As in the turbine blade assembly of the above-described embodiment, a turbine blade assembly of this modified example also includes a rotor disk and a turbine blade attached to the rotor disk.

Figure 9:
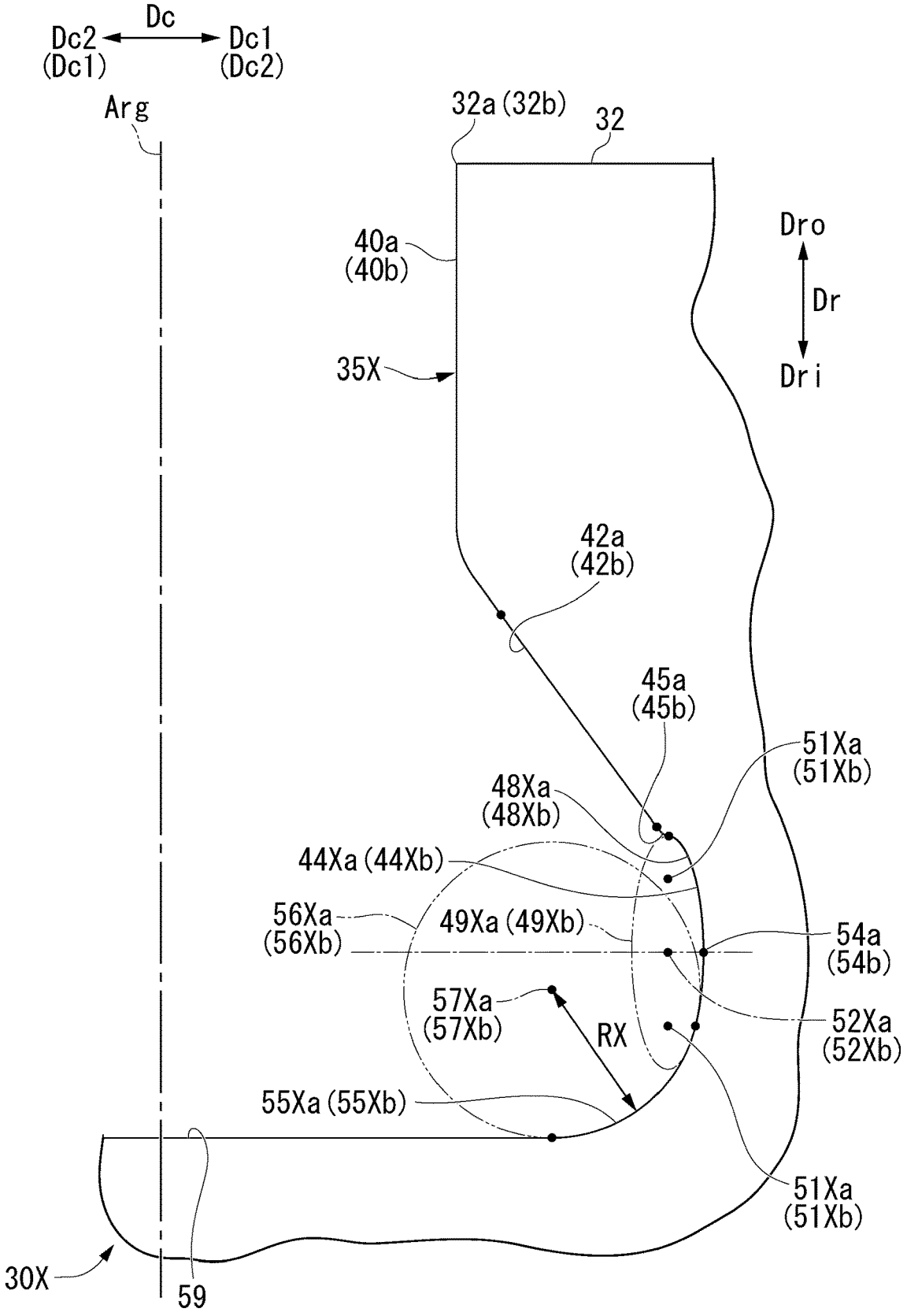
FIG. 9 is a front view of a main part of a rotor disk according to a first modified example of the embodiment of the present disclosure.

As shown in FIG. 9, a rotor disk 30X of this modified example also includes a blade root groove 35X as in the rotor disk 30 of the above-described embodiment. The blade root groove 35X also includes the first blade root neck facing surface 40*a*, the second blade root neck facing surface 40*b*, the first bearing surface 42*a*, the second bearing surface 42*b*, a first disk neck outer curved surface 44Xa, a second disk neck outer curved surface 44Xb, a first disk neck inner curved surface 55Xa, a second disk neck inner curved surface 55Xb, and the bottom surface 59 as in the blade root groove 35 of the above-described embodiment.

In the above-described surfaces of this modified example, the first disk neck outer curved surface 44Xa, the second disk neck outer curved surface 44Xb, the first disk neck inner curved surface 55Xa, and the second disk neck inner curved surface 55Xb are different from the corresponding surfaces of the above-described embodiment. On the other hand, in the above-described surfaces of this modified example, the surfaces except for the first disk neck outer curved surface 44Xa, the second disk neck outer curved surface 44Xb, the first disk neck inner curved surface 55Xa, and the second disk neck inner curved surface 55Xb are the same as the corresponding surfaces of the above-described embodiment.

Even in this modified example, as in the above-described embodiment, the first blade root neck facing surface 40*a* and the second blade root neck facing surface 40*b* are line symmetrical with each other with respect to the blade root groove symmetry axis Arg. The first bearing surface 42*a* and the second bearing surface 42*b* are line symmetrical with each other with respect to the blade root groove symmetry axis Arg. The first disk neck outer curved surface 44Xa and the second disk neck outer curved surface 44Xb are line symmetrical with each other with respect to the blade root groove symmetry axis Arg. The first disk neck inner curved surface 55Xa and the second disk neck inner curved surface 55Xb are line symmetrical with each other with respect to the blade root groove symmetry axis Arg. Therefore, the first disk neck outer curved surface 44Xa and the first disk neck inner curved surface 55Xa of this modified example will be mainly described below.

The first disk neck outer curved surface 44Xa of this modified example also includes the first flank 45*a* and a first curvature changing surface 48Xa as in the first disk neck outer curved surface 44*a* of the above-described embodiment.

The first flank 45*a* of this modified example is the same as the first flank 45*a* of the above-described embodiment.

The first curvature changing surface 48Xa of this modified example is a curved surface of which a curvature gradually increases from the first disk neck position 54*a* toward the outer radial side Dro as in the first curvature changing surface 48*a* of the above-described embodiment. The edge of the first curvature changing surface 48Xa on the outer radial side Dro is connected to the edge of the first flank 45*a* on the inner radial side Dri. The first curvature changing surface 48Xa is an elliptical arc surface defined by a part of a first ellipse 49Xa determined by two focal points 51Xa arranged in the radial direction Dr inside the blade root groove 35X. The first disk neck position 54*a* and the ellipse center 52Xa of the first ellipse 49Xa are located at the same position in the radial direction Dr as in the above-described embodiment.

A portion on the inner radial side Dri of the first disk neck inner curved surface 55Xa of this modified example is an arc surface defined by a part of the first circle 56Xa centered on a point 57Xa inside the blade root groove 35X. The radius RX of the first circle 56Xa of this modified example is smaller than the radius R of the first circle 56*a* of the above-described embodiment. Further, the center point 57Xa of the first circle 56Xa of this modified example is located on the inner radial side Dri in relation to the first disk neck position 54*a* and the ellipse center 52Xa of the first ellipse 49Xa of this modified example.

A portion on the outer radial side Dro of the first disk neck inner curved surface 55Xa of this modified example is an elliptical arc surface defined by another part of the first ellipse 49Xa defining the first curvature changing surface 48Xa of this modified example.

That is, a portion on the outer radial side Dro of the first disk neck inner curved surface 55Xa of this modified example and the first curvature changing surface 48Xa of the first disk neck outer curved surface 44Xa of this modified example are elliptical arc surfaces defined by a part of the same first ellipse 49Xa.

Furthermore, even in the blade root fitted into the blade root groove 35X of this modified example, although not shown in the drawings, a portion on the outer radial side Dro of the first disk neck facing inner curved surface and the first curvature changing surface of the first disk neck facing outer curved surface may be elliptical arc surfaces defined by a part of the same ellipse. In this case, only a portion on the inner radial side Dri in the first disk neck facing inner curved surface of the blade root becomes an arc surface defined by a circle.

As described above, the shape of the first disk neck outer curved surface 44Xa and the shape of the second disk neck outer curved surface 44Xb of this modified example may be changed from the surface shapes of the corresponding surfaces of the above-described embodiment.

Since the first curvature changing surface 48Xa of the first disk neck outer curved surface 44Xa of this modified example is a curved surface of which a curvature gradually increases from the first disk neck position 54*a* toward the outer radial side Dro as in the first curvature changing surface 48*a* of the first disk neck outer curved surface 44*a* of the above-described embodiment, even in this modified example, the stress generated in the disk neck portion 58 of the rotor disk 30X can be alleviated as in the above-described embodiment.

"Second Modified Example of Turbine Blade Assembly"

A turbine blade assembly of this modified example also includes a rotor disk and a turbine blade attached to the rotor disk as in the turbine blade assembly of the above-described embodiment.

Figure 10:
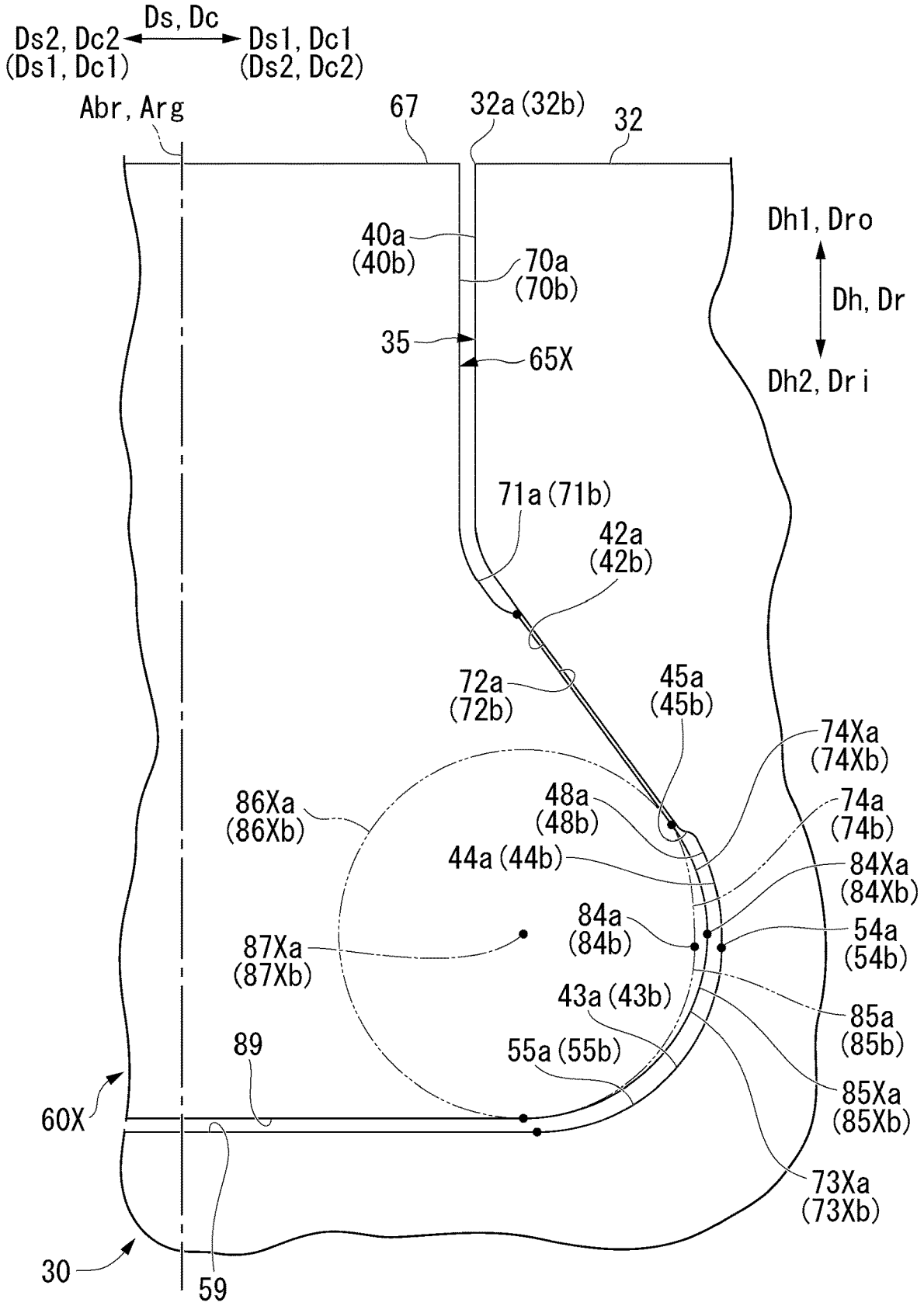
FIG. 10 is a front view of a main part of a turbine vane assembly according to a second modified example of the embodiment of the present disclosure and is a cross-sectional view taken along a line X-X of FIG. 9.

As shown in FIG. 10, the rotor disk 30 of this modified example is the same as the rotor disk 30 of the above-described embodiment. Thus, the rotor disk 30 of this modified example includes the blade root groove 35 which is the same as the blade root groove 35 of the rotor disk 30 of the above-described embodiment. On the other hand, a blade root 65X of a turbine blade 60X of this modified example is different from the blade root 65 of the turbine blade 60 of the above-described embodiment.

As in the blade root 65 of the above-described embodiment, the blade root 65X of this modified example includes the first neck surface 70*a*, the second neck surface 70*b*, the first bearing surface 72*a*, the second bearing surface 72*b*, a first disk neck facing outer curved surface 74Xa, a second disk neck facing outer curved surface 74Xb, a first disk neck facing inner curved surface 85Xa, a second disk neck facing inner curved surface 85Xb, and the bottom surface 89.

In the above-described surfaces of this modified example, the first disk neck facing outer curved surface 74Xa, the second disk neck facing outer curved surface 74Xb, the first disk neck facing inner curved surface 85Xa, and the second disk neck facing inner curved surface 85Xb are different from the corresponding surfaces of the above-described embodiment. On the other hand, in the above-described surfaces of this modified example, the surfaces except for the first disk neck facing outer curved surface 74Xa, the second disk neck facing outer curved surface 74Xb, the first disk neck facing inner curved surface 85Xa, and the second disk neck facing inner curved surface 85Xb are the same as the corresponding surfaces of the above-described embodiment.

Even in this modified example, as in the above-described embodiment, the first neck surface 70*a* and the second neck surface 70*b* are line symmetrical with each other with respect to the line of the blade root symmetry axis Abr. The first bearing surface 72*a* and the second bearing surface 72*b* are line symmetrical with each other with respect to the line of the blade root symmetry axis Abr. The first disk neck facing outer curved surface 74Xa and the second disk neck facing outer curved surface 74Xb are line symmetrical with each other with respect to the line of the blade root symmetry axis Abr.

The first disk neck facing inner curved surface 85Xa and the second disk neck facing inner curved surface 85Xb are line symmetrical with each other with respect to the line of the blade root symmetry axis Abr. Thus, the first disk neck facing outer curved surface 74Xa and the first disk neck facing inner curved surface 85Xa will be mainly described below.

As in the first disk neck facing outer curved surface 74*a* of the above-described embodiment, the first disk neck facing outer curved surface 74Xa of this modified example is a curved surface which gradually moves toward the first circumferential side Dc1 as it goes from the edge on the inner radial side Dri of the first bearing surface 72*a* toward the inner radial side Dri. However, the first disk neck facing outer curved surface 74Xa of this modified example is an arc surface defined by a part of a first circle 86Xa centered on a point 87Xa inside the blade root 65X. Thus, the first disk neck facing outer curved surface 74Xa is a constant curvature surface.

As in the first disk neck facing inner curved surface 85*a* of the above-described embodiment, the first disk neck facing inner curved surface 85Xa of this modified example is an arc surface which gradually moves toward the second lateral side Ds2 as it goes from a first veritop position 84Xa corresponding to the edge on the second blade height side Dh2 of the first disk neck facing outer curved surface 74Xa toward the second blade height side Dh2. However, the first disk neck facing inner curved surface 74Xa of this modified example is an arc surface defined by a part of the first circle 86Xa defining the first disk neck facing outer curved surface 74Xa. Thus, the first disk neck facing inner curved surface 85Xa is a constant curvature surface.

Thus, in this modified example, the surface shapes of the disk neck facing curved surfaces 73Xa and 73Xb of the blade root 65X do not correspond to the surface shapes of the disk neck curved surfaces 43*a* and 43*b* of the blade root groove 35.

As described above, since the rotor disk 30 of the turbine vane assembly of this modified example also includes the blade root groove 35 which is the same as the blade root groove 35 of the above-described embodiment, the stress generated in the disk neck portion 58 of the rotor disk 30 can be alleviated as in the above-described embodiment.

Incidentally, as described above, in this modified example, the surface shapes of the disk neck facing curved surfaces 73Xa and 73Xb do not correspond to the surface shapes of the disk neck curved surfaces 43*a* and 43*b* of the blade root groove 35. On the other hand, in the above-described embodiment, the surface shapes of the disk neck facing curved surfaces 73*a* and 73*b* of the blade root 65 correspond to the surface shapes of the disk neck curved surfaces 43*a* and 43*b* of the blade root groove 35. Therefore, in the embodiment in which the surface shapes of the disk neck facing curved surfaces 73*a* and 73*b* of the blade root 65 correspond to the surface shapes of the disk neck curved surfaces 43*a* and 43*b* of the blade root groove 35, the blade root 65 is easily fitted into the blade root groove 35. That is, as in the above-described embodiment, when the surface shapes of the disk neck facing curved surfaces 73*a* and 73*b* of the blade root 65 correspond to the surface shapes of the disk neck curved surfaces 43*a* and 43*b* of the blade root groove 35, assembling workability of the turbine blade 60 to the rotor disk 30 can be improved.

Other Modified Examples

The curvature changing surface in the above-described embodiments and modified examples is an elliptical arc surface defined by a part of an ellipse. However, the curvature changing surface may be a curved surface defined by a multidimensional function such as a quadratic function or a cubic function.

The turbine blade assembly in the above-described embodiments and modified examples is a turbine blade assembly in a gas turbine compressor. However, as long as an axial flow fluid machine includes a rotor disk and turbine blades, the configuration disclosed above may be applied to the turbine blade assembly of the axial flow fluid machine other than the compressor of the gas turbine.

The present disclosure is not limited to the above-described embodiments and modified examples. Various additions, changes, substitutions, partial deletions, and the like can be made without departing from the conceptual idea and spirit of the present disclosure derived from the content defined in the claims and equivalents thereof.

"Appendix"

The rotor disks in the above-described embodiments and modified examples can be understood, for example, as follows.

(1) The rotor disks of the first aspect are the rotor disks 30 and 30X having a disk shape centered on the axis Ar and having the turbine blades 60 and 60X on the outer peripheral side.

The rotor disks 30 and 30X include the outer peripheral surface 32 and the plurality of blade root grooves 35 and 35X which are recessed from the outer peripheral surface 32 toward the inner radial side Dri with respect to the axis Ar and into which the blade roots 65 and 65X of the turbine blades 60 and 60X are insertable. The plurality of blade root grooves 35 and 35X are arranged at intervals in the circumferential direction Dc with respect to the axis Ar. Each of the plurality of blade root grooves 35 and 35X includes the pair of blade root neck facing surfaces 40*a* and 40*b*, the pair of bearing surfaces 42*a* and 42*b*, the pair of disk neck curved surfaces 43*a* and 43*b*, and the bottom surface 59. The first blade root neck facing surface 40*a* which is one surface of the pair of blade root neck facing surfaces 40*a* and 40*b* spreads from the first circumferential position 32*a* of the outer peripheral surface 32 in the circumferential direction Dc in a direction having a component of the inner radial side Dri. The second blade root neck facing surface 40*b* which is the other surface of the pair of blade root neck facing surfaces 40*a* and 40*b* spreads from the second circumferential position 32*b* separated from the first circumferential position 32*a* toward the second circumferential side Dc2 between the first circumferential side Dc1 and the second circumferential side Dc2 of the circumferential direction Dc in the outer peripheral surface 32 in a direction having a component on the inner radial side Dri and faces the first blade root neck facing surface 40*a* in the circumferential direction Dc. The first bearing surface 42*a* which is one surface of the pair of bearing surfaces 42*a* and 42*b* is an inclined plane which gradually moves toward the first circumferential side Dc1 as it goes from the edge on the inner radial side Dri of the first blade root neck facing surface 40*a* toward the inner radial side Dri. The second bearing surface 42*b* which is the other surface of the pair of bearing surfaces 42*a* and 42*b* is an inclined plane which gradually moves toward the second circumferential side Dc2 as it goes from the edge on the inner radial side Dri of the second blade root neck facing surface 40*b* toward the inner radial side Dri and faces the first bearing surface 42*a* in the circumferential direction Dc. The first disk neck curved surface 43*a* which is one surface of the pair of disk neck curved surfaces 43*a* and 43*b* includes the first disk neck outer curved surfaces 44*a* and 44Xa which gradually move toward the first circumferential side Dc1 as it goes from the edge on the inner radial side Dri of the first bearing surface 42*a* toward the inner radial side Dri and the first disk neck inner curved surfaces 55*a* and 55Xa which gradually move toward the second circumferential side Dc2 as it goes from the first disk neck position 54*a* corresponding to the edge on the inner radial side Dri of the first disk neck outer curved surfaces 44*a* and 44Xa toward the inner radial side Dri. The second disk neck curved surface 43*b* which is the other surface of the pair of disk neck curved surfaces 43*a* and 43*b* includes the second disk neck outer curved surfaces 44*b* and 44Xb which gradually move toward the second circumferential side Dc2 as it goes from the edge on the inner radial side Dri of the second bearing surface 42*b* toward the inner radial side Dri and the second disk neck inner curved surfaces 55*b* and 55Xb which gradually move toward the first circumferential side Dc1 as it goes from the second disk neck position 54*b* corresponding to the edge on the inner radial side Dri of the second disk neck outer curved surfaces 44*b* and 44Xb toward the inner radial side Dri. The second disk neck outer curved surfaces 44*b* and 44Xb face the first disk neck outer curved surfaces 44*a* and 44Xa in the circumferential direction Dc. The second disk neck inner curved surfaces 55*b* and 55Xb face the first disk neck inner curved surfaces 55*a* and 55Xa in the circumferential direction Dc. The second disk neck position 54*b* faces the first disk neck position 54*a* in the circumferential direction Dc. The bottom surface 59 is a plane which faces the outer radial side Dro opposite to the inner radial side Dri and connects the edge on the inner radial side Dri of the first disk neck inner curved surfaces 55*a* and 55Xa and the edge on the inner radial side Dri of the second disk neck inner curved surfaces 55*b* and 55Xb. The first disk neck outer curved surfaces 44*a* and 44Xa include the first curvature changing surfaces 48*a* and 48Xa of which a curvature gradually increases from the first disk neck position 54*a* toward the outer radial side Dro.

The second disk neck outer curved surfaces 44*b* and 44Xb include the second curvature changing surfaces 48*b* and 48Xb of which a curvature gradually increases from the second disk neck position 54*b* toward the outer radial side Dro.

In this aspect, the gap between the first disk neck position 54*a* and the second disk neck position 54*b* in the circumferential direction Dc is the maximum groove width W of the blade root grooves 35 and 35X in the circumferential direction Dc.

In order to describe the effect of this aspect, the rotor disk 30C of the comparative example will be described below.

As in the rotor disks 30 and 30X of this aspect, the rotor disk 30C of the comparative example also includes the blade root groove 35C which is recessed from the outer peripheral surface 32 toward the inner radial side Dri.

As in the blade root grooves 35 and 35X of this aspect, the blade root groove 35C of the comparative example also includes the first blade root neck facing surface 40*a*, the second blade root neck facing surface 40*b*, the first bearing surface 42*a*, the second bearing surface 42*b*, the first disk neck outer curved surface 44Ca, the second disk neck outer curved surface 44Cb, the first disk neck inner curved surface 55Ca, the second disk neck inner curved surface 55Cb, and the bottom surface 59. In the above-described surfaces of the comparative example, the first disk neck outer curved surface 44Ca and the second disk neck outer curved surface 44Cb are the corresponding surfaces of the blade root grooves 35 and 35X of this aspect.

The first disk neck outer curved surface 44Ca of the comparative example includes the first constant curvature surface 53*a* instead of the first curvature changing surfaces 48*a* and 48Xa of the first disk neck outer curved surfaces 44*a* and 44Xa of the above-described embodiment. The first constant curvature surface 53*a* is an arc surface defined by a part of the first circle 56Ca centered on the point 57Ca inside the blade root groove 35C. Further, the second disk neck outer curved surface 44Cb of the comparative example includes the second constant curvature surface 53*b* instead of the second curvature changing surface 48*b* of the second disk neck outer curved surfaces 44*b* and 44Xb of the above-described embodiment. The second constant curvature surface 53*b* is an arc surface defined by a part of the second circle 56Cb centered on the point 57Cb inside the blade root grooves 35 and 35XC.

Even in the comparative example, the gap between the first disk neck position 54Ca corresponding to the edge on the inner radial side Dri of the first constant curvature surface 53*a* and the second disk neck position 54Cb corresponding to the edge on the inner radial side Dri of the second constant curvature surface 53*b* in the circumferential direction Dc is the maximum groove width WC of the blade root groove 35C in the circumferential direction Dc.

Here, it is assumed that the ratio of a change amount in the circumferential direction Dc with respect to a unit change amount in the radial direction Dr on each surface described above is defined as a change rate.

Further, in this aspect, it is assumed that the change rate of the edge on the outer radial side Dro of each of the first curvature changing surfaces 48*a* and 48Xa and the change rate of the edge on the inner radial side Dri of the surface connected to the outer radial side Dro of each of the first curvature changing surfaces 48*a* and 48Xa match or are similar. Similarly, in the comparative example, it is assumed that the change rate of the edge on the outer radial side Dro of the first constant curvature surface 53*a* and the change rate of the edge on the inner radial side Dri of the surface connected to the outer radial side Dro of the first constant curvature surface 53*a* match or are similar.

The first curvature changing surfaces 48*a* and 48Xa of this aspect are curved surfaces of which a curvature gradually increases from the first disk neck position 54*a* toward the outer radial side Dro. Further, the first constant curvature surface 53*a* of the comparative example is an arc surface defined by a part of the first circle 56Ca. Therefore, the position in the circumferential direction Dc at the point of the first radial position in each of the first curvature changing surfaces 48*a* and 48Xa is closer to the second circumferential side Dc2 than the position in the circumferential direction Dc at the point of the first radial position of the first constant curvature surface 53*a*.

Thus, the first disk neck position 54*a* of this aspect is closer to the second circumferential side Dc2 than the first disk neck position 54Ca of the comparative example.

Further, in this aspect, it is assumed that the change rate of the edge on the outer radial side Dro of each of the second curvature changing surfaces 48*b* and 48Xb and the change rate of the edge on the inner radial side Dri of the surface connected to the outer radial side Dro of each of the second curvature changing surfaces 48*b* and 48Xb match or are similar. Similarly, in the comparative example, it is assumed that the change rate of the edge on the outer radial side Dro of the second constant curvature surface 53*b* and the change rate of the edge on the inner radial side Dri of the surface connected to the outer radial side Dro of the second constant curvature surface 53*b* match or are similar.

The second curvature changing surfaces 48*b* and 48Xb of this aspect are curved surfaces of which a curvature gradually increases from the second disk neck position 54*b* toward the outer radial side Dro. Further, the second constant curvature surface 53*b* of the comparative example is an arc surface defined by a part of the second circle 56Cb. Therefore, the position in the circumferential direction Dc at the point of the first radial position of each of the second curvature changing surfaces 48*b* and 48Xb is closer to the first circumferential side Dc1 than the position in the circumferential direction Dc at the point of the first radial position of the second constant curvature surface 53*b*.

Thus, the second disk neck position 54*b* of this aspect is closer to the first circumferential side Dc1 than the second disk neck position 54*b* of the comparative example.

Therefore, in this aspect, the maximum groove width W can be narrower than the maximum groove width WC of the comparative example without changing the width in the circumferential direction Dc of each of the bearing surfaces 42*a* and 42*b* receiving a load applied from the blade roots 65 and 65X from the width in the circumferential direction Dc of each of the bearing surfaces 42*a* and 42*b* of the comparative example. In other words, in this aspect, the minimum gap L between the blade root grooves 35 and 35X adjacent to each other in the circumferential direction Dc can be wider than the minimum gap LC between the blade root grooves 35XC adjacent to each other in the circumferential direction Dc of the comparative example without changing the width in the circumferential direction Dc of each of the bearing surfaces 42*a* and 42*b* receiving a load from the blade roots 65 and 65X from the width in the circumferential direction Dc of each of the bearing surfaces 42*a* and 42*b* of the comparative example. That is, in this aspect, it is possible to widen the gap in the circumferential direction Dc of the disk neck portion 58 which is a portion between a portion having the widest groove width in the first blade root grooves 35 and 35X and a portion having the widest groove width in the second blade root grooves 35 and 35X adjacent to the first blade root grooves 35 and 35X in the circumferential direction Dc in the rotor disks 30 and 30X compared to the comparative example. Thus, in this aspect, the stress generated in the disk neck portion 58 of the rotor disks 30 and 30X can be alleviated compared to the comparative example.

Further, in this aspect, the curvature on the surface around the first disk neck position 54*a* and the curvature on the surface around the second disk neck position 54*b* are smaller than those of the comparative example. Thus, in this aspect, from this viewpoint, the stress generated in the disk neck portion 58 of the rotor disks 30 and 30X can be alleviated compared to the comparative example.

(2) According to the rotor disk of the second aspect, in the rotor disks 30 and 30X of the first aspect, the first curvature changing surfaces 48*a* and 48Xa are elliptical arc surfaces defined by a part of the first ellipses 49*a* and 49Xa determined by two focal points 51*a* and 51Xa arranged in the radial direction Dr with respect to the axis Ar inside the blade root grooves 35 and 35X. The second curvature changing surfaces 48*b* and 48Xb are elliptical arc surfaces defined by a part of the second ellipses 49*b* and 49Xb determined by two focal points 51*b* and 51Xb arranged in the radial direction Dr inside the blade root grooves 35 and 35X.

(3) According to the rotor disk of the third aspect, in the rotor disks 30 and 30X of the first aspect or the second aspect, at least a portion on the inner radial side Dri of the first disk neck inner curved surfaces 55*a* and 55Xa is an arc surface defined by a part of the first circles 56*a* and 56Xa centered on the points 57*a* and 57Xa inside the blade root grooves 35 and 35X. At least a portion on the inner radial side Dri of the second disk neck inner curved surfaces 55*b* and 55Xb is an arc surface defined by a part of the second circles 56*b* and 56Xb centered on the points 57*b* and 57Xb inside the blade root grooves 35 and 35X.

(4) According to the rotor disk of the fourth aspect, in the rotor disks 30 and 30X of the second aspect, at least a portion on the inner radial side Dri of the first disk neck inner curved surfaces 55*a* and 55Xa is an arc surface defined by a part of the first circles 56*a* and 56Xa centered on the points 57*a* and 57Xa inside the blade root grooves 35 and 35X. At least a portion on the inner radial side Dri in the second disk neck inner curved surfaces 55*b* and 55Xb is an arc surface defined by a part of the second circles 56*b* and 56Xb centered on the points 57*b* and 57Xb inside the blade root grooves 35 and 35X. The major axes A and AX of the first ellipses 49*a* and 49Xa are larger than the radii R and RX of the first circles 56*a* and 56Xa. The minor axis B of the first ellipses 49*a* and 49Xa is smaller than the radii R and RX of the first circles 56*a* and 56Xa. The major axes A and AXb of the second ellipses 49*b* and 49Xb are larger than the radii R and RX of the second circles 56*b* and 56Xb. The minor axis B of the second ellipses 49*b* and 49Xb is smaller than the radii R and RX of the second circles 56*b* and 56Xb.

(5) According to the rotor disk of the fifth aspect, in the rotor disks 30 and 30X of any one of the first aspect to the fourth aspect, the first disk neck outer curved surfaces 44*a* and 44Xa include the first flank 45*a* which gradually moves toward the first circumferential side Dc1 as it goes from the edge on the inner radial side Dri of the first bearing surface 42*a* toward the inner radial side Dri and of which a change amount toward the first circumferential side Dc1 with respect to a unit change amount toward the inner radial side Dri is larger than that of the first bearing surface 42*a*. The second disk neck outer curved surfaces 44*b* and 44Xb include the second flank 45*b* which gradually moves toward the second circumferential side Dc2 as it goes from the edge on the inner radial side Dri of the second bearing surface 42*b* toward the inner radial side Dri and of which a change amount toward the second circumferential side Dc2 with respect to a unit change amount toward the inner radial side Dri is larger than that of the second bearing surface 42*b*. The edge on the inner radial side Dri of the first flank 45*a* is connected to the edge on the outer radial side Dro of each of the first curvature changing surfaces 48*a* and 48Xa. The edge on the inner radial side Dri of the second flank 45*b* is connected to the edge on the outer radial side Dro of each of the second curvature changing surfaces 48*b* and 48Xb. The second flank 45*b* faces the first flank 45*a* in the circumferential direction Dc.

When the rotor disks 30 and 30X are rotating, each of the bearing surfaces 42*a* and 42*b* of the blade root grooves 35 and 35X receives a load from the turbine blades 60 and 60X. In this aspect, since the flanks 45*a* and 45*b* are connected to the edge on the inner radial side Dri of each of the bearing surfaces 42*a* and 42*b*, this load can be suppressed from going around toward the disk neck portion 58. Thus, in this aspect, the stress generated in the disk neck portion 58 of the rotor disks 30 and 30X can be alleviated.

(6) According to the rotor disk of the sixth aspect, in the rotor disks 30 and 30X of the fifth aspect, the first flank 45*a* is an arc surface defined by a part of the first groove outer circle 46*a* centered on a point which is outside the blade root grooves 35 and 35X and closer to a point on the first circumferential side Dc1 than the first blade root neck facing surface 40*a*. The second flank 45*b* is an arc surface defined by a part of the second groove outer circle 46*b* centered on a point which is outside the blade root grooves 35 and 35X and closer to a point on the second circumferential side Dc2 than the second blade root neck facing surface 40*b*.

The turbine blades in the above-described embodiments and modified examples can be understood, for example, as follows.

(7) The turbine blade of the seventh aspect includes the blade body 61 which has an airfoil-shaped cross section and extends in the blade height direction Dh perpendicular to the cross section and the blade root 65 which is provided on the second blade height side Dh2 of the blade body 61 between the first blade height side Dh1 and the second blade height side Dh2 in the blade height direction Dh and is fitted into the blade root grooves 35 and 35X of the rotor disks 30 and 30X having a disk shape centered on the axis Ar. The blade body 61 includes the leading edge 62*f*, the trailing edge 62*b*, the concave pressure surface 63*p* connecting the leading edge 62*f* and the trailing edge 62*b*, and the convex curved suction surface 63*n* connecting the leading edge 62*f* and the trailing edge 62*b*. The blade root 65 includes the front-end surface 66*f* which faces the front side which is the side where the leading edge 62*f* is present with respect to the trailing edge 62*b*, the rear-end surface 66*b* which faces the rear side which is the opposite to the front side, and the side surface 68 which connects the edge of the front-end surface 66*f* and the edge of the rear-end surface 66*b*. The side surface 68 of the blade root 65 includes the pair of neck surfaces 70*a* and 70*b*, the pair of bearing surfaces 72*a* and 72*b*, the pair of disk neck facing curved surfaces 73*a* and 73*b*, and the bottom surface 89. The first neck surface 70*a* which is one surface of the pair of neck surfaces 70*a* and 70*b* spreads in a direction having a component on the blade height direction Dh. The second neck surface 70*b* which is the other surface of the pair of neck surfaces 70*a* and 70*b* spreads in a direction having a component on the blade height direction Dh, faces the first neck surface 70*a* in the lateral direction Ds along the front-end surface 66*f* to be perpendicular to the blade height direction Dh, and is located on the second lateral side Ds2 between the first lateral side Ds1 and the second lateral side Ds2 of the lateral direction Ds with respect to the first neck surface 70*a*. The first bearing surface 72*a* which is one surface of the pair of bearing surfaces 72*a* and 72*b* is an inclined plane which gradually moves toward the first lateral side Ds1 as it goes from the edge on the second blade height side Dh2 of the first neck surface 70*a* toward the second blade height side Dh2. The second bearing surface 72*b* which is the other surface of the pair of bearing surfaces 72*a* and 72*b* is an inclined plane which gradually moves toward the second lateral side Ds2 as it goes from the edge on the second blade height side Dh2 of the second neck surface 70*b* toward the second blade height side Dh2 and faces the first bearing surface 72*a* in the lateral direction Ds. The first disk neck facing curved surface 73*a* which is one surface of the pair of disk neck facing curved surfaces 73*a* and 73*b* includes the first disk neck facing outer curved surface 74*a* which gradually moves toward the first lateral side Ds1 as it goes from the edge on the second blade height side Dh2 of the first bearing surface 72*a* toward the second blade height side Dh2 and the first disk neck facing inner curved surface 85*a* which gradually moves toward the second lateral side Ds2 as it goes from the first veritop position 84*a* corresponding to the edge on the second blade height side Dh2 of the first disk neck facing outer curved surface 74*a* toward the second blade height side Dh2. The second disk neck facing curved surface 73*b* which is the other surface of the pair of disk neck facing curved surfaces 73*a* and 73*b* includes the second disk neck facing outer curved surface 74*b* which gradually moves toward the second lateral side Ds2 as it goes from the edge on the second blade height side Dh2 of the second bearing surface 72*b* toward the second blade height side Dh2 and the second disk neck facing inner curved surface 85*b* which gradually moves toward the first lateral side Ds1 as it goes from the second veritop position 84*b* corresponding to the edge on the second blade height side Dh2 of the second disk neck facing outer curved surface 74*b* toward the second blade height side Dh2. The second disk neck facing outer curved surface 74*b* faces the first disk neck facing outer curved surface 74*a* in the lateral direction Ds. The second disk neck facing inner curved surface 85*b* faces the first disk neck facing inner curved surface 85*a* in the lateral direction Ds. The second veritop position 84*b* faces the first veritop position 84*a* in the lateral direction Ds. The bottom surface 89 is a plane which faces the second blade height side Dh2 and connects the edge on the second blade height side Dh2 of the first disk neck facing inner curved surface 85*a* and the edge on the second blade height side Dh2 of the second disk neck facing inner curved surface 85*b*. The first disk neck facing outer curved surface 74*a* includes the first curvature changing surface 78*a* of which a curvature gradually increases from the first veritop position 84*a* toward the first blade height side Dh1.

The second disk neck facing outer curved surface 74*b* includes the second curvature changing surface 78*b* of which a curvature gradually increases from the second veritop position 84*b* toward the first blade height side Dh1.

The surface shapes of the disk neck facing curved surfaces 73*a* and 73*b* of the turbine blade 60 of this aspect correspond to the surface shapes of the disk neck curved surfaces 43*a* and 43*b* of the blade root grooves 35 and 35X of the above-described first aspect. Therefore, the blade root 65 of the turbine blade 60 of this aspect is easily fitted into the blade root grooves 35 and 35X of the first aspect. That is, when the blade root grooves 35 and 35X of the first aspect are adopted, assembling workability of the turbine blade 60 to the rotor disks 30 and 30X can be improved by adopting the blade root 65 of this aspect.

(8) According to the turbine blade of the eighth aspect, in the turbine blade 60 of the seventh aspect, the first curvature changing surface 78*a* is an elliptical arc surface defined by a part of the first ellipse 79*a* determined by two focal points 81*a* arranged in the blade height direction Dh inside the blade root 65. The second curvature changing surface 78*b* is an elliptical arc surface defined by a part of the second ellipse 79*b* determined by two focal points 81*b* arranged in the blade height direction Dh inside the blade root 65.

(9) According to the turbine blade of the ninth aspect, in the turbine blade 60 of the seventh aspect or the eighth aspect, at least a portion on the second blade height side Dh2 of the first disk neck facing inner curved surface 85*a* is an arc surface defined by a part of the first circle 86*a* centered on the point 87*a* inside the blade root 65. At least a portion on the second blade height side Dh2 of the second disk neck facing inner curved surface 85*b* is an arc surface defined by a part of the second circle 86*b* centered on the point 87*b* inside the blade root 65.

(10) According to the turbine blade of the tenth aspect, in the turbine blade 60 of the eighth aspect, at least a portion on the second blade height side Dh2 of the first disk neck facing inner curved surface 85*a* is an arc surface defined by a part of the first circle 86*a* centered on the point 87*a* inside the blade root 65. At least a portion on the second blade height side Dh2 of the second disk neck facing inner curved surface 85*b* is an arc surface defined by a part of the second circle 86*b* centered on the point 87*b* inside the blade root 65. The major axis Ab of the first ellipse 79*a* is larger than the radius Rb of the first circle 86*a*. The minor axis Bb of the first ellipse 79*a* is smaller than the radius Rb of the first circle 86*a*. The major axis Ab of the second ellipse 79*b* is larger than the radius Rb of the second circle 86*b*. The minor axis Bb of the second ellipse 79*b* is smaller than the radius Rb of the second circle 86*b*.

(11) According to the turbine blade of the eleventh aspect, in the turbine blade 60 of any one of the seventh aspect to the tenth aspect, the first neck surface 70*a* includes the first flank 71*a* which gradually moves toward the second lateral side Ds2 as it goes from the edge on the first blade height side Dh1 of the first bearing surface 72*a* toward the first blade height side Dh1. A change amount toward the second lateral side Ds2 with respect to a unit change amount toward the first blade height side Dh1 in the first flank 71*a* is larger than a change amount toward the second lateral side Ds2 with respect to a unit change amount toward the first blade height side Dh1 in the first bearing surface 72*a*. The second neck surface 70*b* includes the second flank 71*b* which gradually moves toward the first lateral side Ds1 as it goes from the edge on the first blade height side Dh1 of the second bearing surface 72*b* toward the first blade height side Dh1. A change amount toward the first lateral side Ds1 with respect to a unit change amount toward the first blade height side Dh1 in the second flank 71*b* is larger than a change amount toward the first lateral side Ds1 with respect to a unit change amount toward the first blade height side Dh1 in the second bearing surface 72*b*. The second flank 71*b* faces the first flank 71*a* in the lateral direction Ds.

The turbine blade assemblies in the above-described embodiments and modified examples can be understood, for example, as follows.

(12) The turbine blade assembly according to the twelfth aspect includes the rotor disks 30 and 30X of any one of the first aspect to the sixth aspect and the turbine blade 60 of any one of the seventh aspect to the eleventh aspect. The blade root 65 of the turbine blade 60 is fitted into any one of the plurality of blade root grooves 35 and 35X of the rotor disks 30 and 30X. The blade height direction Dh regarding the turbine blade 60 forms the radial direction Dr, the first blade height side Dh1 forms the outer radial side Dro, and the second blade height side Dh2 forms the inner radial side Dri. The lateral direction Ds regarding the turbine blade 60 forms the circumferential direction Dc, the first lateral side Ds1 forms the first circumferential side Dc1, and the second lateral side Ds2 forms the second circumferential side Dc2. The first neck surface 70*a* of the turbine blade 60 faces the first blade root neck facing surface 40*a* of each of the blade root grooves 35 and 35X.

The second neck surface 70*b* of the turbine blade 60 faces the second blade root neck facing surface 40*b* of each of the blade root grooves 35 and 35X. The first bearing surface 72*a* of the turbine blade 60 faces the first bearing surface 42*a* of each of the blade root grooves 35 and 35X. The second bearing surface 72*b* of the turbine blade 60 faces the second bearing surface 42*b* of each of the blade root grooves 35 and 35X. The first disk neck facing outer curved surface 74*a* of the turbine blade 60 faces the first disk neck outer curved surfaces 44*a* and 44Xa of the blade root grooves 35 and 35X. The second disk neck facing outer curved surface 74*b* of the turbine blade 60 faces the second disk neck outer curved surfaces 44*b* and 44Xb of the blade root grooves 35 and 35X. The first disk neck facing inner curved surface 85*a* of the turbine blade 60 faces the first disk neck inner curved surfaces 55*a* and 55Xa of the blade root grooves 35 and 35X. The second disk neck facing inner curved surface 85*b* of the turbine blade 60 faces the first disk neck inner curved surfaces 55*a* and 55Xa of the blade root grooves 35 and 35X. When the first neck surface 70*a* of the turbine blade 60 is in contact with the first blade root neck facing surfaces 40*a* of the blade root grooves 35 and 35X, the second neck surface 70*b* of the turbine blade 60 is in contact with the second blade root neck facing surfaces 40*b* of the blade root grooves 35 and 35X.

The turbine blade assembly of this aspect includes the rotor disks 30 and 30X of any one of the first aspect to the sixth aspect. Thus, even in this aspect, the stress generated in the disk neck portion 58 of the rotor disks 30 and 30X can be alleviated as in the rotor disks 30 and 30X of the above-described first aspect.

Further, the turbine blade assembly of this aspect includes the turbine blade 60 according to any one of the seventh aspect to the eleventh aspect. Thus, even in this aspect, as in the turbine blade 60 of the seventh aspect, assembling workability of the turbine blade 60 to the rotor disks 30 and 30X can be improved.

EXPLANATION OF REFERENCES

1 Gas turbine rotor
2 Intermediate casing
10 Turbine
11 Turbine rotor
11*s* Turbine rotor shaft
11*b* Turbine blade row
12 Turbine casing
13 Turbine vane row
15 Combustor
20 Compressor
21 Compressor rotor
21*s* Compressor rotor shaft
21*b* Compressor blade row
22 Compressor casing
23 Compressor vane row
24 Intake air volume regulator
24*v* Inlet guide vane
24*d* Driver
30, 30X, 30C Rotor disk
31*f* Front-end surface
31*b* Rear-end surface
32 Outer peripheral surface
32*a* First circumferential position
32*b* Second circumferential position
35, 35X, 35C Blade root groove
40*a*, 40*b* Blade root neck facing surface
40*a* First blade root neck facing surface
40*b* Second blade root neck facing surface
42*a*, 42*b* Bearing surface
42*a* First bearing surface
42*b* Second bearing surface
43*a*, 43*b* Disk neck curved surface
43*a*, 43Ca First disk neck curved surface
43*b*, 43Cb Second disk neck curved surface
44*a*, 44Xa, 44Ca First disk neck outer curved surface
44*b*, 44Xb, 44Cb Second disk neck outer curved surface
45*a* First flank
45*b* Second flank
46*a* First groove outer circle
46*b* Second groove outer circle
47*a*, 47*b* Point
48*a*, 48Xa First curvature changing surface
48*b*, 48Xb Second curvature changing surface
49*a*, 49Xa First ellipse
49*b*, 49Xb Second ellipse
51*a*, 51*b*, 51Xa, 51Xb Focal point
52*a*, 52*b* Ellipse center
53*a* First constant curvature surface
53*b* Second constant curvature surface
54*a*, 54Ca First disk neck position
54*b*, 54Cb Second disk neck position
55*a*, 55Xa, 55Ca First disk neck inner curved surface
55*b*, 55Xb, 55Cb Second disk neck inner curved surface
56*a*, 56Xa, 56Ca First circle
56*b*, 56Xb, 56Cb Second circle
57*a*, 57Ca, 57*b*, 57Cb Point
58 Disk neck portion
59 Bottom surface
60, 60X Turbine blade
61 Blade body
62*f* Leading edge
62*b* Trailing edge
63*p* Pressure surface
63*n* Suction surface
65, 65X Blade root
66*f* Front-end surface
66*b* Rear-end surface
67 Gas path surface
68 Side surface
70*a*, 70*b* Neck surface
70*a* First neck surface
70*b* Second neck surface
71*a* First flank
71*b* Second flank
72*a*, 72*b* Bearing surface
72*a* First bearing surface
72*b* Second bearing surface
73*a*, 73*b*, 73Xa, 73Xb Disk neck facing curved surface
73*a* First disk neck facing curved surface
73*b* Second disk neck facing curved surface
74*a*, 74Xa First disk neck facing outer curved surface
74*b*, 74Xb Second disk neck facing outer curved surface
78*a* First curvature changing surface
78*b* Second curvature changing surface
79*a* First ellipse
79*b* Second ellipse
81*a*, 81*b* Focal point
82*a*, 82*b* Ellipse center
84*a*, 84Xa First veritop position
84*b*, 84Xb Second veritop position
85*a*, 85Xa First disk neck facing inner curved surface
85*b*, 85Xb Second disk neck facing inner curved surface
86*a*, 86Xa First circle
86*b*, 86Xb Second circle
87*a*, 87*b*, 87Xa, 87Xb Point
89 Bottom surface
A Air
F Fuel
G Combustion gas
Ar Rotor axis
Arg Blade root groove symmetry axis
Abr Blade root symmetry axis
W, WC Maximum groove width
L, LC Minimum gap
Da Rotor axis direction
Dau Upstream axis side
Dad Downstream axis side
Dc Circumferential direction
Dc1 First circumferential side
Dc2 Second circumferential side
Dr Radial direction
Dri Inner radial side
Dro Outer radial side
Dh Blade height direction Dh1 First blade height side
Dh2 Second blade height side
Ds Lateral direction
Ds1 First lateral side
Ds2 Second lateral side

What is claimed is:

1. A rotor disk having a disk shape centered on an axis and having a turbine blade on an outer peripheral side, comprising:

an outer peripheral surface; and a plurality of blade root grooves which are recessed from the outer peripheral surface toward a radially inward direction with respect to the axis and into which a blade root of the turbine blade is insertable, wherein the plurality of blade root grooves are arranged at intervals in a circumferential direction with respect to the axis, wherein each of the plurality of blade root grooves includes a pair of blade root neck facing surfaces, a pair of bearing surfaces, a pair of disk neck curved surfaces, and a bottom surface, wherein a first blade root neck facing surface which is one surface of the pair of blade root neck facing surfaces spreads in a direction having a component in the radially inward direction with respect to the axis from a first circumferential position in the circumferential direction of the outer peripheral surface, wherein a second blade root neck facing surface which is the other surface of the pair of blade root neck facing surfaces spreads in a direction having a component in the radially inward direction with respect to the axis from a second circumferential position separated from the first circumferential position toward a second circumferential side between a first circumferential side and the second circumferential side of the circumferential direction in the outer peripheral surface and faces the first blade root neck facing surface in the circumferential direction, wherein a first bearing surface which is one surface of the pair of bearing surfaces is an inclined plane which gradually extends toward the first circumferential side as the first bearing surface extends from an edge on the radially inward side of the first blade root neck facing surface toward the radially inward direction, wherein a second bearing surface which is the other surface of the pair of bearing surfaces is an inclined plane which gradually extends toward the second circumferential side as the second bearing surface extends from an edge on the radially inward side of the second blade root neck facing surface toward the radially inward direction and faces the first bearing surface in the circumferential direction, wherein a first disk neck curved surface which is one surface of the pair of disk neck curved surfaces includes a first disk neck outer curved surface which gradually extends toward the first circumferential side as the first disk neck outer curved surface extends from an edge on the radially inward side of the first bearing surface toward the radially inward direction, and a first disk neck inner curved surface which gradually extends toward the second circumferential side as the first disk neck inner curved surface extends from a first disk neck position corresponding to an edge on the radially inward side of the first disk neck outer curved surface toward the radially inward direction, wherein a second disk neck curved surface which is the other surface of the pair of disk neck curved surfaces includes a second disk neck outer curved surface which gradually extends toward the second circumferential side as the second disk neck outer curved surface extends from an edge on the radially inward side of the second bearing surface toward the radially inward direction, and a second disk neck inner curved surface which gradually extends toward the radially inward direction as the second disk neck inner curved surface extends from a second disk neck position corresponding to an edge on the radially inward side of the second disk neck outer curved surface toward the first circumferential side, wherein the second disk neck outer curved surface faces the first disk neck outer curved surface in the circumferential direction, wherein the second disk neck inner curved surface faces the first disk neck inner curved surface in the circumferential direction, wherein the second disk neck position faces the first disk neck position in the circumferential direction, wherein the bottom surface is a plane which faces a radially outward side opposite to the radially inward side and connects an edge on the radially inward side of the first disk neck inner curved surface and an edge on the radially inward side of the second disk neck inner curved surface, wherein the first disk neck outer curved surface includes a first curvature changing surface of which a curvature gradually increases from the first disk neck position toward the radially outward direction, the first curvature changing surface being an elliptical arc surface defined by a part of a first ellipse determined by two focal points arranged in a radial direction with respect to the axis inside the blade root groove, and wherein the second disk neck outer curved surface includes a second curvature changing surface of which a curvature gradually increases from the second disk neck position toward the radially outward direction, the second curvature changing surface being an elliptical arc surface defined by a part of a second ellipse determined by two focal points arranged in the radial direction inside the blade root groove.

2. The rotor disk according to claim 1, wherein at least a portion on the inner radial side of the first disk neck inner curved surface is an arc surface defined by a part of a first circle centered on a point inside the blade root groove, and wherein at least a portion on the inner radial side in the second disk neck inner curved surface is an arc surface defined by a part of a second circle centered on a point inside the blade root groove.

3. The rotor disk according to claim 1, wherein at least a portion on the inner radial side of the first disk neck inner curved surface is an arc surface defined by a part of a first circle centered on a point inside the blade root groove, wherein at least a portion on the inner radial side of the second disk neck inner curved surface is an arc surface defined by a part of a second circle centered on a point inside the blade root groove, wherein a major axis of the first ellipse is larger than a radius of the first circle, wherein a minor axis of the first ellipse is smaller than the radius of the first circle, wherein a major axis of the second ellipse is larger than a radius of the second circle, and wherein a minor axis of the second ellipse is smaller than the radius of the second circle.

4. The rotor disk according to claim 1, wherein the first disk neck outer curved surface includes a first flank which gradually extends toward the first circumferential side as the first flank extends from an edge on the inner radial side of the first bearing surface toward the inner radial side and of which a change amount toward the first circumferential side with respect to a unit change amount toward the inner radial side is larger than that of the first bearing surface, wherein the second disk neck outer curved surface includes a second flank which gradually extends toward the second circumferential side as the second flank extends from an edge on the inner radial side of the second bearing surface toward the inner radial side and of which a change amount toward the second circumferential side with respect to a unit change amount toward the inner radial side is larger than that of the second bearing surface, wherein an edge of the inner radial side of the first flank is connected to an edge on the outer radial side of the first curvature changing surface, wherein an edge on the inner radial side of the second flank is connected to an edge on the outer radial side of the second curvature changing surface, and wherein the second flank faces the first flank in the circumferential direction.

5. The rotor disk according to claim 4, wherein the first flank is an arc surface defined by a part of a first groove outer circle centered on a point which is outside the blade root groove and closer to the first circumferential side than the first blade root neck facing surface, and wherein the second flank is an arc surface defined by a part of a second groove outer circle centered on a point which is outside the blade root groove and closer to the second circumferential side than the second blade root neck facing surface.

6. A turbine blade comprising:

a blade body which has an airfoil-shaped cross section and extends in a blade height direction perpendicular to the cross section; and a blade root which is provided on a second blade height side of the blade body between a first blade height side and the second blade height side of the blade height direction and is fitted into a blade root groove of a rotor disk having a disk shape centered on an axis, wherein the blade body includes a leading edge, a trailing edge, a concave curved pressure surface which connects the leading edge and the trailing edge, and a convex curved suction surface which connects the leading edge and the trailing edge, wherein the blade root includes a front-end surface which faces a front side which is a side where the leading edge is present with respect to the trailing edge, a rear-end surface which faces a rear side opposite to the front side, and a side surface which connects an edge of the front-end surface and an edge of the rear-end surface, wherein the side surface of the blade root includes a pair of neck surfaces, a pair of bearing surfaces, a pair of disk neck facing curved surfaces, and a bottom surface, wherein a first neck surface which is one surface of the pair of neck surfaces spreads in a direction having a component on the blade height direction, wherein a second neck surface which is the other surface of the pair of neck surfaces spreads in a direction having a component on the blade height direction, faces the first neck surface in a lateral direction along the front-end surface to be perpendicular to the blade height direction, and is located on a second lateral side of the lateral direction with respect to the first neck surface, wherein a first bearing surface which is one surface of the pair of bearing surfaces is an inclined plane which gradually extends toward a first lateral side of the lateral direction as the first bearing surface extends from an edge on the second blade height side of the first neck surface toward the second blade height side, wherein a second bearing surface which is the other surface of the pair of bearing surfaces is an inclined plane which gradually extends toward the second lateral side as the second bearing surface extends from an edge on the second blade height side of the second neck surface toward the second blade height side and faces the first bearing surface in the lateral direction, wherein a first disk neck facing curved surface which is one surface of the pair of disk neck facing curved surfaces includes a first disk neck facing outer curved surface which gradually extends toward the first lateral side as the first disk neck facing outer curved surface extends from an edge on the second blade height side of the first bearing surface toward the second blade height side, and a first disk neck facing inner curved surface which gradually extends toward the second lateral side as the first disk neck facing inner curved surface extends from a first peak position corresponding to an edge on the second blade height side of the first disk neck facing outer curved surface toward the second blade height side, wherein a second disk neck facing curved surface which is the other surface of the pair of disk neck facing curved surfaces includes a second disk neck facing outer curved surface which gradually extends toward the second lateral side as the second disk neck facing outer curved surface extends from an edge on the second blade height side of the second bearing surface toward the second blade height side, and a second disk neck facing inner curved surface which gradually extends toward the first lateral side as the second disk neck facing inner curved surface extends from a second peak position corresponding to an edge on the second blade height side of the second disk neck facing outer curved surface toward the second blade height side, wherein the second disk neck facing outer curved surface faces the first disk neck facing outer curved surface in the lateral direction, wherein the second disk neck facing inner curved surface faces the first disk neck facing inner curved surface in the lateral direction, wherein the second peak position faces the first peak position in the lateral direction, wherein the bottom surface is a plane which faces the second blade height side and connects an edge on the second blade height side of the first disk neck facing inner curved surface and edge on the second blade height side of the second disk neck facing inner curved surface, wherein the first disk neck facing outer curved surface includes a first curvature changing surface of which a curvature gradually increases from the first peak position toward the first blade height side, the first curvature changing surface being an elliptical arc surface defined by a part of a first ellipse determined by two focal points arranged in the blade height direction inside the blade root, and wherein the second disk neck facing outer curved surface includes a second curvature changing surface of which a curvature gradually increases from the second peak position toward the first blade height side, the second curvature changing surface being an elliptical arc surface defined by a part of a second ellipse determined by two focal points arranged in the blade height direction inside the blade root.

7. The turbine blade according to claim 6, wherein at least a portion on the second blade height side of the first disk neck facing inner curved surface is an arc surface defined by a part of a first circle centered on a point inside the blade root, and wherein at least a portion on the second blade height side of the second disk neck facing inner curved surface is an arc surface defined by a part of a second circle centered on a point inside the blade root.

8. The turbine blade according to claim 6, wherein at least a portion on the second blade height side of the first disk neck facing inner curved surface is an arc surface defined by a part of a first circle centered on a point inside the blade root, wherein at least a portion on the second blade height side of the second disk neck facing inner curved surface is an arc surface defined by a part of a second circle centered on a point inside the blade root, wherein a major axis of the first ellipse is larger than a radius of the first circle, wherein a minor axis of the first ellipse is smaller than the radius of the first circle, wherein a major axis of the second ellipse is larger than a radius of the second circle, and wherein a minor axis of the second ellipse is smaller than the radius of the second circle.

9. The turbine blade according to claim 6, wherein the first neck surface includes a first flank which gradually extends toward the second lateral side as the first flank extends from an edge on the first blade height side of the first bearing surface toward the first blade height side, wherein a change amount toward the second lateral side with respect to a unit change amount toward the first blade height side in the first flank is larger than a change amount toward the second lateral side with respect to a unit change amount toward the first blade height side in the first bearing surface, wherein the second neck surface includes a second flank which gradually extends toward the first lateral side as the second flank extends from an edge on the first blade height side of the second bearing surface toward the first blade height side, wherein a change amount toward the first lateral side with respect to a unit change amount toward the first blade height side in the second flank is larger than a change amount toward the first lateral side with respect to a unit change amount toward the first blade height side in the second bearing surface, and wherein the second flank faces the first flank in the lateral direction.

10. A turbine blade assembly comprising:

the rotor disk according to claim 1; and a turbine blade including:

a blade body which has an airfoil-shaped cross section and extends in a blade height direction perpendicular to the cross section; and a blade root which is provided on a second blade height side of the blade body between a first blade height side and the second blade height side of the blade height direction and is fitted into a blade root groove of a rotor disk having a disk shape centered on an axis, wherein the blade body includes a leading edge, a trailing edge, a concave curved pressure surface which connects the leading edge and the trailing edge, and a convex curved suction surface which connects the leading edge and the trailing edge, wherein the blade root includes a front-end surface which faces a front side which is a side where the leading edge is present with respect to the trailing edge, a rear-end surface which faces a rear side opposite to the front side, and a side surface which connects an edge of the front-end surface and an edge of the rear-end surface, wherein the side surface of the blade root includes a pair of neck surfaces, a pair of bearing surfaces, a pair of disk neck facing curved surfaces, and a bottom surface, wherein a first neck surface which is one surface of the pair of neck surfaces spreads in a direction having a component on the blade height direction, wherein a second neck surface which is the other surface of the pair of neck surfaces spreads in a direction having a component on the blade height direction, faces the first neck surface in a lateral direction along the front-end surface to be perpendicular to the blade height direction, and is located on a second lateral side of the lateral direction with respect to the first neck surface, wherein a first bearing surface which is one surface of the pair of bearing surfaces is an inclined plane which gradually extends toward a first lateral side of the lateral direction as the first bearing surface extends from an edge on the second blade height side of the first neck surface toward the second blade height side, wherein a second bearing surface which is the other surface of the pair of bearing surfaces is an inclined plane which gradually extends toward the second lateral side as the second bearing surface extends from an edge on the second blade height side of the second neck surface toward the second blade height side and faces the first bearing surface in the lateral direction, wherein a first disk neck facing curved surface which is one surface of the pair of disk neck facing curved surfaces includes a first disk neck facing outer curved surface which gradually extends toward the first lateral side as the first disk neck facing outer curved surface extends from an edge on the second blade height side of the first bearing surface toward the second blade height side, and a first disk neck facing inner curved surface which gradually extends toward the second lateral side as the first disk neck facing inner curved surface extends from a first peak position corresponding to an edge on the second blade height side of the first disk neck facing outer curved surface toward the second blade height side, wherein a second disk neck facing curved surface which is the other surface of the pair of disk neck facing curved surfaces includes a second disk neck facing outer curved surface which gradually extends toward the second lateral side as the second disk neck facing outer curved surface extends from an edge on the second blade height side of the second bearing surface toward the second blade height side, and a second disk neck facing inner curved surface which gradually extends toward the first lateral side as the second disk neck facing inner curved surface extends from a second peak position corresponding to an edge on the second blade height side of the second disk neck facing outer curved surface toward the second blade height side, wherein the second disk neck facing outer curved surface faces the first disk neck facing outer curved surface in the lateral direction, wherein the second disk neck facing inner curved surface faces the first disk neck facing inner curved surface in the lateral direction, wherein the second peak position faces the first peak position in the lateral direction, wherein the bottom surface is a plane which faces the second blade height side and connects an edge on the second blade height side of the first disk neck facing inner curved surface and edge on the second blade height side of the second disk neck facing inner curved surface, wherein the first disk neck facing outer curved surface includes a first curvature changing surface of which a curvature gradually increases from the first peak position toward the first blade height side, and wherein the second disk neck facing outer curved surface includes a second curvature changing surface of which a curvature gradually increases from the second peak position toward the first blade height side, wherein the blade root of the turbine blade is fitted to any one of the plurality of blade root grooves of the rotor disk, wherein the blade height direction regarding the turbine blade forms the radial direction, the first blade height side forms the outer radial side, and the second blade height side forms the inner radial side, wherein the lateral direction regarding the turbine blade forms the circumferential direction, the first lateral side forms the first circumferential side, and the second lateral side forms the second circumferential side, wherein the first neck surface of the turbine blade faces the first blade root neck facing surface of the blade root groove, wherein the second neck surface of the turbine blade faces the second blade root neck facing surface of the blade root groove, wherein the first bearing surface of the turbine blade faces the first bearing surface of the blade root groove, wherein the second bearing surface of the turbine blade faces the second bearing surface of the blade root groove, wherein the first disk neck facing outer curved surface of the turbine blade faces the first disk neck outer curved surface of the blade root groove, wherein the second disk neck facing outer curved surface of the turbine blade faces the second disk neck outer curved surface of the blade root groove, wherein the first disk neck facing inner curved surface of the turbine blade faces the first disk neck inner curved surface of the blade root groove, wherein the second disk neck facing inner curved surface of the turbine blade faces the first disk neck inner curved surface of the blade root groove, and wherein when the first neck surface of the turbine blade is in contact with the first blade root neck facing surface of the blade root groove, the second neck surface of the turbine blade is in contact with the second blade root neck facing surface of the blade root groove.

* * * * *